US007698987B2

(12) United States Patent
Jebsen et al.

(10) Patent No.: US 7,698,987 B2
(45) Date of Patent: Apr. 20, 2010

(54) HEAVY CALIBER FIREARM WITH ENHANCED RECOIL AND CONTROL CHARACTERISTICS

(75) Inventors: Jan Henrik Jebsen, Nyon (CH); Renaud Kerbrat, Nyon (CH)

(73) Assignee: Gamma KDG Systems SA, Nyon (CH)

( * ) Notice: Subject to any disclaimer, the term of this patent is extended or adjusted under 35 U.S.C. 154(b) by 0 days.

(21) Appl. No.: 10/454,785

(22) Filed: Jun. 5, 2003

(65) Prior Publication Data

US 2004/0069138 A1 Apr. 15, 2004

Related U.S. Application Data

(60) Provisional application No. 60/459,969, filed on Apr. 4, 2003.

(30) Foreign Application Priority Data

Jun. 7, 2002 (CH) ..... 0975/02
Jul. 31, 2002 (CH) ..... 1343/02
Apr. 15, 2003 (CH) ..... 0679/03

(51) Int. Cl.
*F41A 3/56* (2006.01)

(52) U.S. Cl. ..... 89/191.01; 89/25

(58) Field of Classification Search ..... 42/30, 42/31, 32, 36; 89/23, 25, 182, 183, 189, 89/190, 168, 175, 176, 191.01, 192, 14.3
See application file for complete search history.

(56) References Cited

U.S. PATENT DOCUMENTS 918,760 A * 4/1909 Mauser ..... 89/176
954,543 A * 4/1910 Ross ..... 89/175
1,425,627 A * 8/1922 Bardelli ..... 89/149
1,457,961 A 6/1923 Browning
1,497,096 A 6/1924 Eriksen
1,835,715 A 12/1931 McCoy
2,365,188 A 12/1944 Gorton
2,590,981 A * 4/1952 Lippert et al. ..... 89/190
2,775,166 A * 12/1956 Janson ..... 89/190
2,789,479 A * 4/1957 McColl ..... 89/190
3,000,268 A 9/1961 Robinson (Continued)

FOREIGN PATENT DOCUMENTS

BE 351672 6/1928

(Continued)

OTHER PUBLICATIONS

Mercury Recoil Suppressor from http://www.mercuryrecoil.com, Nov. 13, 2002, 3 pages.

(Continued)

*Primary Examiner*—Stephen M Johnson
(74) *Attorney, Agent, or Firm*—Wiley Rein LLP

(57) ABSTRACT

The invention comprises an improved recoil control device comprising a bolt head and an inertia block for use in a variety of firearms. In one embodiment, the bolt head and inertia block are articulated so that the displacement of the bolt head results in a force component outside the firing axis of the barrel of the firearm. The device can be incorporated into firearms of a variety of sizes and configurations to produce recoil reduction and/or weight reduction advantages.

38 Claims, 36 Drawing Sheets

U.S. PATENT DOCUMENTS

| | | | | | |
|---|---|---|---|---|---|
| 3,489,060 | A | | 1/1970 | Marocchi | |
| 3,503,299 | A | * | 3/1970 | Joyce et al. | 89/7 |
| 3,554,077 | A | | 1/1971 | Schlapia, Jr. | |
| 3,580,132 | A | | 5/1971 | Vartanian | |
| 3,641,867 | A | | 2/1972 | Junker | |
| 3,650,060 | A | | 3/1972 | Schubert | |
| 3,656,400 | A | * | 4/1972 | Stoner et al. | 89/138 |
| 3,661,049 | A | * | 5/1972 | Perrine | 89/189 |
| 3,683,534 | A | | 8/1972 | Davis | |
| 3,698,285 | A | * | 10/1972 | Wilhelm | 89/189 |
| 3,709,091 | A | * | 1/1973 | Perrine | 89/189 |
| 3,756,119 | A | * | 9/1973 | Curtis et al. | 89/33.2 |
| 4,088,057 | A | | 5/1978 | Nasypany | |
| 4,112,605 | A | | 9/1978 | Staub | |
| 4,126,077 | A | | 11/1978 | Quesnel | |
| 4,164,825 | A | | 8/1979 | Hutchison | |
| 4,167,890 | A | | 9/1979 | Adams | |
| 4,279,091 | A | | 7/1981 | Edwards | |
| 4,301,712 | A | | 11/1981 | Cristina | |
| 4,391,180 | A | | 7/1983 | Koine | |
| 4,439,943 | A | | 4/1984 | Brakhage | |
| 4,447,975 | A | | 5/1984 | Ljutic | |
| 4,492,050 | A | | 1/1985 | Kagehiro | |
| 4,503,632 | A | | 3/1985 | Cuevas | |
| 4,514,921 | A | | 5/1985 | Burkleca | |
| 4,604,942 | A | * | 8/1986 | Benelli | 89/185 |
| 4,719,841 | A | | 1/1988 | Perrine | |
| 4,769,937 | A | | 9/1988 | Gregory et al. | |
| 4,840,107 | A | | 6/1989 | Weldon | |
| 4,867,038 | A | | 9/1989 | Metz | |
| 4,910,904 | A | | 3/1990 | Rose | |
| 4,932,148 | A | * | 6/1990 | Barrett | 42/18 |
| 4,974,493 | A | | 12/1990 | Yeffman | |
| 4,986,018 | A | | 1/1991 | McDonald, Jr. | |
| 5,031,348 | A | | 7/1991 | Carey | |
| 5,069,110 | A | | 12/1991 | Menck | |
| 5,138,931 | A | | 8/1992 | Brookshire | |
| 5,279,202 | A | * | 1/1994 | Bellardi et al. | 89/198 |
| 5,343,649 | A | | 9/1994 | Petrovich | |
| 5,519,957 | A | | 5/1996 | Iannetta | |
| 5,524,374 | A | | 6/1996 | Gernstein | |
| 5,581,046 | A | | 12/1996 | Weldle et al. | |
| 5,585,590 | A | | 12/1996 | Ducolon | |
| 5,652,406 | A | * | 7/1997 | Phan | 89/14.3 |
| 5,669,173 | A | | 9/1997 | Rodney, Jr. | |
| 5,678,345 | A | | 10/1997 | Gnade | |
| 5,682,007 | A | | 10/1997 | Dobbins | |
| 5,722,195 | A | | 3/1998 | Bentley et al. | |
| 5,758,447 | A | | 6/1998 | Venetz | |
| 5,811,720 | A | | 9/1998 | Quinnell et al. | |
| 5,909,002 | A | | 6/1999 | Atchisson | |
| 5,911,173 | A | | 6/1999 | Westrom | |
| 5,952,602 | A | | 9/1999 | Gussalli Beretta | |
| 5,979,098 | A | | 11/1999 | Griggs | |
| 5,983,549 | A | | 11/1999 | Battaglia | |
| 6,044,748 | A | | 4/2000 | Westrom | |
| 6,055,760 | A | | 5/2000 | Cuson et al. | |
| 6,079,138 | A | | 6/2000 | Meaker | |
| 6,079,311 | A | | 6/2000 | O'Quinn et al. | |
| 6,196,108 | B1 | | 3/2001 | Murello | |
| 6,243,978 | B1 | | 6/2001 | Vignaroli et al. | |
| 6,269,727 | B1 | | 8/2001 | Nigge | |
| 6,305,115 | B1 | | 10/2001 | Cook | |
| 6,343,536 | B1 | | 2/2002 | Rossier et al. | |
| 6,357,157 | B1 | | 3/2002 | Constant et al. | |
| 6,418,833 | B1 | | 7/2002 | Hajjar | |
| 2002/0053156 | A1 | | 5/2002 | McCarthy | |
| 2002/0139241 | A1 | | 10/2002 | Butler | |
| 2003/0051600 | A1 | | 3/2003 | Breuer et al. | |
| 2003/0056639 | A1 | | 3/2003 | Giza | |
| 2004/0025680 | A1 | | 2/2004 | Jebsen et al. | |
| 2004/0069137 | A1 | | 4/2004 | Jebsen et al. | |

FOREIGN PATENT DOCUMENTS

| | | | | |
|---|---|---|---|---|
| CH | 43050 | | | 4/1909 |
| DE | 33 09 921 | A1 | * | 9/1984 |
| FR | 969669 | | | 12/1950 |
| FR | 1193803 | | | 11/1959 |
| WO | WO 03/104737 | A1 | | 12/2003 |
| WO | WO 03/104738 | A1 | | 12/2003 |
| WO | WO 03/104739 | A1 | | 12/2003 |

OTHER PUBLICATIONS

Sprinco Recoil Reduction Guide Rods from http://aps.3av.com/about.htm, Nov. 13, 2002, 2 pages.

* cited by examiner

HEAVY CALIBER FIREARM WITH ENHANCED RECOIL AND CONTROL CHARACTERISTICS

RELATED APPLICATIONS

This application claims priority to U.S. Provisional Application No. 60/459,969, filed Apr. 4, 2003, which is incorporated by reference in its entirety. This application also claims priority to Swiss Application Nos. 0975/02, filed Jun. 7, 2002, 1343/02, filed Jul. 31, 2002, and 0679/03, filed Apr. 15, 2003, which are incorporated by reference in their entirety.

FIELD OF INVENTION

This invention relates to small and heavy caliber firearms and cannons as well as to improved methods and devices for reducing the consequences of recoil and improving performance in firearms and cannons. In a particular embodiment, the device relates to the control or management of the recoil forces for semiautomatic or automatic firearms.

BACKGROUND FOR AND INTRODUCTION TO THE INVENTION

Historically, firearms were built to be loaded and fired mechanically. Even today, many heavy caliber guns and cannons are loaded by hand or individually loaded. For automatic weapons, the rapid firing of successive cartridges induces various side effects that prove detrimental both to accuracy and effectiveness. Traditionally, a gun was considered to work like a heat engine, in which about thirty percent of the energy developed by the propellant powder is dissipated as heat, forty percent as muzzle blast and recoil, and only the remaining thirty percent was effectively used to propel the bullet out of the barrel. Successive designs of automatic weapons tried to make use of the vast amount of wasted energy to help make the automatic cycling operate better. Three general systems were used. Hiram Maxim was the first to use recoil forces to mechanize the ejection and loading actions in a machine gun, Browning put the muzzle blast to effective use, and Bergman devised the simple blowback action. Thus, the three basic ways of obtaining an automatic operation were developed from the use of recoil, gas, or blowback actuation.

Later applications of the blowback operation used either simple blowback or assisted blowback, with or without locked, delayed, hesitation or retarded blowback, and even blowback with advanced primer ignition. Gas operation leads to the use of long and short-stroke pistons and even, in more modern weapons, direct gas action, where the derived gas directly activates a bolt carrier in which an adequate recess is managed. Recoil operation traditionally provided the locking mechanism of the bolt to the barrel so that they can slide together under the thrust of the pressure when firing, either under a short or long recoil operation and with or without muzzle boosters or recoil intensifiers.

Throughout these improvements, a main issue was safety. Therefore, all systems were engineered to ensure an accurate duration of locking the breech to the barrel until the gas pressure falls to a safe level once the projectile has exited the barrel. The main breech locking systems used either separate revolving chambers, the rotation of which provides an adequate duration of protection, or toggle systems, rotating bolts, tilting breech blocks, lug systems, or even non-ramming breech blocks. A common but unsatisfactory feature among all theses mechanisms is that they do not prevent the undesirable side effects during automatic firing, which accounts for the adverse effects on accuracy and ease of use.

Thus, the mechanisms found on current firearms, although reliable and widely employed, nevertheless suffer from a number of deficiencies. For example, some mechanisms increase the length of the housing of the breech, resulting in interior clutter and increased weight. The amplitude of recoil is relatively critical due to its effect on accuracy, and the existing mechanisms fail to provide a satisfactory or optimum reduction in recoil, which permits the resulting upward movement of the barrel. More particularly, the direction of the recoil forces generally coincides with the longitudinal axis of the gun barrel. The gun barrel is generally located above the shoulder in a person firing a rifle or above the hand in a handgun, and more precisely above the gap between the thumb and index finger of a person firing a handgun. This configuration generates a moment that causes the upward jerking of the gun familiar to every user. Heavy caliber firearms and cannons experience the same upward forces upon firing, which often results in heavy strains on the mounting or emplacement apparatus. For these and other reasons, improvements in the design and operation of small and heavy caliber firearms and cannons are desired in the art.

The innovative approaches taken here make a more effective use of the available energy and, in particular, recycle, as much as practicable, the wasted energy by departing from the traditional and historical mechanisms. In one aspect, this invention provides new solutions, mechanisms, and systems for operating the firing action of a firearm and allows revolutionary changes in the use and ergonomics applicable to firearm design and control.

Taking into account all these adverse or secondary effects that impede the use of all firearms, and in particular automatic firearms, in which energy is essentially wasted beyond that necessary for propelling the projectile, the present approach is new and innovative. In general and in one aspect, the invention is aimed at addressing the design of a new firearm by taking advantage of available energy to help operate the firearm and consequently minimize and/or compensate for the adverse effects and improve control. A first innovation is the deliberate use and control of energy to address all the adverse effects during operation. This allows one to conceive of a new firearm design and implementation. This new approach also allows a firearm designer to address concerns and constraints as part of a whole rather than as individual problems, so as to take into account the advantages of an interface between firearm components during its operation. Considering the operation as a whole, as this invention exemplifies, allows completely new concepts and expands the universe of designs, configurations, and mechanisms possible for firearms.

SUMMARY OF THE INVENTION

The present invention addresses the problems and disadvantages associated with conventional firearms and weapon systems and provides improved devices for reducing recoil effects in a variety of firearms, cannons, and systems. The invention also facilitates the design and production of a more compact weapon and/or allows substantial reductions in the weight of the frame, which results in many new design and emplacement possibilities and improvements, and incorporating one or more of the many aspects of the invention into a firearm improves accuracy and/or reduces the total weight.

One of the fundamental principles of the present invention is the transfer of mechanical recoil forces to a direction outside of the longitudinal axis of the gun barrel. As can be seen in each of the exemplary embodiments disclosed herein, the transfer of forces disperses or dissipates recoil forces and thereby reduces the moment responsible for the upward jerking characteristic of conventional firearms. The mechanism that transfers forces can be oriented to counteract the recoil forces along the longitudinal axis of the gun barrel to effectively eliminate or compensate for the upward jerking of the weapon. For example, a pair of inertia blocks of substantially equal mass can be oriented such that their respective movements in response to firing will be synchronized, equal in magnitude, and with corresponding but opposite components of momentum oriented outside the longitudinal axis of the barrel. The net effect is that the opposite movement or displacement of the inertia blocks first absorbs the recoil forces and prevents the weapon from being pushed rearward. Second, the lateral momentum of one moving inertia block cancels the other, thereby inducing no net lateral force or even agitation of the firearm. Thus, the portion of the recoil forces beyond those used to operate the novel mechanisms or system of the invention is transferred in a direction outside the longitudinal axis of the barrel and effectively disposed of by being cancelled out, thereby significantly reducing or even eliminating the component of recoil forces along the longitudinal axis of the barrel that is responsible for the reactive jerking of the weapon when fired. One of skill in the art will recognize that the embodiments disclosed herein are exemplary and that one or more of the foregoing principles can be applied in many variations to firearms of various calibers and applications.

In one embodiment, the device according to the invention is based on an arrangement of articulated parts constituting a mobile breech. The nature of the assembly allows displacement of at least one of the parts in the assembly, which acts as an inertia block, in a movement that alternates out of and in to alignment with the longitudinal axis of the barrel. This action is contrary to the action of conventional breech locking mechanisms in which the whole breech moves in translation true to the axis of the barrel.

A novel aspect of this new mechanism originates in the transmission of forces and energy from the action of recoil to the inertia block in the instant immediately following percussion by means of an impulse occurring in a direction other than along the axis of the gun barrel, ideally perpendicular to that axis, with the bolt head checked in its movement by a locking mechanism. To enhance the transfer of energy to the inertia block, and thus to induce its greater movement, the mechanism is engineered to produce a slight time-lapse (or phase displacement) in the initial movements of the inertia block and the bolt head through a delay in release of the locking mechanism. Accordingly, the inertia block of mass M is activated, rotating with an initial velocity Vm, its momentum running through a number of movements. Once the inertia block is in motion, the locking mechanism (the locking cylinder or spool in chambered position with the bolt or bolt head) unlocks to liberate the bolt head. The continuing trajectory of the inertia block then compels a translated displacement of the bolt head towards the rear of the weapon due to the nature of the means of its linkage with the inertia block. Continuing its rotation to maximum lateral extension, the inertia block encounters resistance due a mechanism for energy recuperation, ideally one of elastic counter-stress or a spring, which deflects the inertia block to fold itself again laterally on the gun. The nature of the linkage of the inertia block with the bolt head drives the latter forward, compelling insertion of a round in the firing chamber by conventional technique. Arrival of the inertia block at the end of its refolding activates the locking mechanism, which secures the bolt head in firing position.

According to a preferred embodiment of this invention, a firearm or recoil control device or mechanism is composed of two like inertia blocks set symmetrically about the axis of the gun barrel. Each inertia block is linked to the bolt head in a similar fashion. Movement of the two inertia blocks is synchronized. Their respective rotation is complementary and mutually opposed. In this configuration, absorption of recoil is considerably enhanced.

This invention allows several parameters to be varied, notably the ratio between the masses of the inertia blocks and the mass of the bolt head, the ratio of the angle of extension of the deployed or extended inertia block(s) to the axis of the gun barrel, and/or the delay in the intiation or activation of movement in the locking cylinder or spool, or the delay in the initiation or activation of movement of the inertia blocks. The terms locking spool and locking cylinder are used interchangeably.

In one particular embodiment of the present invention, a recoil control device for use in a firearm comprises a bolt head configured to alternate between a forward position and a rearward position in response to the firing of one or more cartridges and an inertia block connected to the bolt head such that said bolt head imparts an impulse to the inertia block as it alternates between the forward position and the rearward position. The impulse imparted to the inertia block may have a component lateral or perpendicular to the firing axis of the barrel of the firearm. Alternately, the movement of the inertia block may have a component lateral to or perpendicular to the firing axis of the barrel of the firearm. In either case, the lateral transfer of momentum substantially reduces the reactive recoil forces.

The mobile breech comprises an inertia block that operates to transfer momentum or forces generated by the firing of one or more cartridges or rounds of ammunition to a direction outside of the longitudinal axis of the gun barrel. In a more basic aspect, the inertia block is a component part of a firearm, or more particularly a mobile breech, that moves in response to the force of firing and/or moves in response to the movement of a bolt head. The inertia block or mass allows for the absorption of recoil forces and directs those forces in the form of momentum in a direction outside the longitudinal axis of the barrel. Throughout this disclosure, the use of the term "inertia block" can refer either to a single or to multiple parts or masses. The component masses of the inertia blocks may optionally serve additional functions, such as providing armor protection to or housing components for gun or cannon emplacements equipped with the present invention.

In a system where the bolt head absorbs the recoil forces directly through contact with the spent casing of the cartridge, the bolt head is imparted with a rearward momentum along the longitudinal axis of the barrel. When the inertia block moves in response to the movement of the bolt head, the bolt head impulsively strikes the inertia block, either directly or through a linkage, and the momentum of the bolt head is then transferred to the inertia block. The bolt head is typically of significantly smaller mass than the inertia block or blocks. Because of the relative masses of the bolt head and inertia block, the inertia block will move with a different velocity than the bolt head.

An aspect of the present invention is the use of inertia block guides to constrain the movement that the inertia block follows to a direction other than along the longitudinal axis of the barrel, thereby transferring the recoil forces out of the axis of the gun barrel and reducing the reactive jerking described above. Alternately, the initial impulse on the inertia block or blocks may be driven not by direct mechanical connection to the bolt head, but by a gas injection system. In that case, the expanding gases created by the firing of one or more cartridges are used to pressurize a gas injection system and the pressure is selectively applied to the inertia block or blocks to cause their movement in a direction other than along the longitudinal axis of the barrel. In any embodiment, the inertia block or blocks serve the same basic function—to absorb recoil forces and or re-direct recoil forces out of the longitudinal axis of the barrel.

The path of the inertia block in response to the recoil impulse leaves the longitudinal axis of the gun barrel, thereby translating recoil forces out of this axis. Part of the space occupied by the inertia block during its back and forth trajectory can be located above or below the axis of the gun barrel.

The inertia block can move along a path defined by its guide. The guide can be a slot in a part of the firearm, or can be a rod or articulated part, or any other component designed to allow the inertia block to move back and forth from a loaded position to an end point of its movement. An inertia block guide can be configured so that the movement of the inertia block in response to the impulse can comprise a rotation or can be one of pure translation or the movement can be more complex in nature. In other words, there can be a direct connection possible between the bolt head and the inertia block that causes the movement of the inertia block to move along its guide, or there can be a simple linkage, such as a pin rod, or there can be more complex linkages, such as multiple rods and/or articulated parts. In a preferred embodiment, the displacement of the inertia block is an alternating pivot movement around a pivot. The inertia block's movement in turn governs the movement of the bolt head and/or vice versa, due to the manner of their linkage.

In one aspect, a phase displacement can be achieved by engineering the linkage between bolt head and inertia block with a slight play, for example, in the longitudinal direction. In another aspect, the phase displacement can be achieved through a delay in the direct contact of the bolt head with the inertia block enabled by the shape or configuration of the contact surfaces. The degree of phase displacement is a matter of design option, but some phase displacement is preferred.

The recoil control device's components can be advantageously prepared with comparatively large parts or large diameter spindles or rods, which simplifies manufacture. This advantage of the present invention greatly improves the reliability in service and the resistance to jamming by sand, mud, and other environmental contaminants and simplifies cleaning and dismantling of the firearm.

The mechanisms and aspects of the invention can be used to complement or improve existing or conventional firearms and can be combined with various arrangements, attachments, and combinations, including without limitation, internal release systems, loading systems, ejection systems, gas injection systems, recoil reduction systems, muzzle brakes, sighting systems, tripods, mounting systems, and firing mechanisms.

In one general aspect, the invention comprises an improved and novel recoil control device for use in a firearm, such as a semiautomatic or automatic firearm, in which, for example, a bolt head is configured to alternate between a forward position and a rearward position in response to the firing of one or more cartridges; and an inertia block is connected to the bolt head such that the bolt head imparts an impulse to the inertia block as it alternates between its forward position and its rearward position, the impulse having a component, or force distribution, or vectorial force component, lateral to the firing axis of the barrel of the firearm. The force transferred to the inertia block can be in any one of several directions and the inertia block can therefore traverse one of a variety of paths from the impulse imparted through the bolt head, including, but not limited to: a downward sloping, straight path toward the anterior of the firearm; a path comprising a rotation; a curved or curvi-linear path; a path extending outward from the barrel; a path moving inward toward the barrel; and a path crossing over the barrel. The path chosen relates to the design characteristics of the firearm desired.

Similarly, the inertia block or mass appropriate for a particular firearm relates to the design characteristics of the firearm. In one embodiment, the inertia block comprises a sloped or angled surface, or a leading sloped surface, that can be contacted by the bolt head to transmit the impulse from firing. In other embodiments, the inertia block comprises a part or parts that reciprocates between two or more positions and moves in response to the impulse from the bolt head. Multiple inertia blocks can also be used so that they move together in response to the bolt head. In another preferred embodiment, the recoil control device of the present invention can be incorporated into heavy caliber firearm and cannon mechanisms. For example, a heavy caliber rifle, such as a vehicle-mounted rifle or portable rifle of between .50 caliber and 155 mm, or even higher, can be produced with an inertia block to translate forces out of the axis of the barrel.

The transfer of the impulse of firing from the bolt head to the inertia block can be through direct contact between the two parts or through a simple or even a complex linkage. In one embodiment, one or more pin and rod assemblies are used. In another embodiment, a pin connected to the bolt head moves within a slot connected to the inertia block. In other embodiments, one or more reciprocating rods connect the bolt head to the inertia block.

For most firearms of the invention, the inertia block and bolt head are designed to automatically return to their resting or chambered position. A variety of mechanisms can be used to move the bolt head and/or inertia block in the return path. A preferred embodiment employs a spring operably connected to or contacting the inertia block, which can be referred to as the return spring. A variety of spring types can be adapted for this purpose. Alternative return or recovery mechanisms can be designed by one of skill in the art.

The recoil control device can be manifested as in one of the numerous Figures accompanying this disclosure. Also, numerous embodiments and alternatives are disclosed in the accompanying claims. In another aspect, the invention provides a method for making a recoil control device of the invention and/or incorporating into a firearm a recoil control device comprising one or more inertia blocks operably connected to a bolt head, or moving in response to other forces, in order to move in a manner that directs momentum outside of the longitudinal axis of the barrel.

Other embodiments and advantages of the invention are set forth in part in the description that follows and, in part, will be obvious from this description, or may be learned from the practice of the invention.

BRIEF DESCRIPTION OF THE DRAWINGS

For a more complete understanding of the invention and some advantages thereof, reference is now made to the following descriptions taken in connection with the accompanying drawings in which.

DETAILED DESCRIPTION OF THE INVENTION

Figure 1:
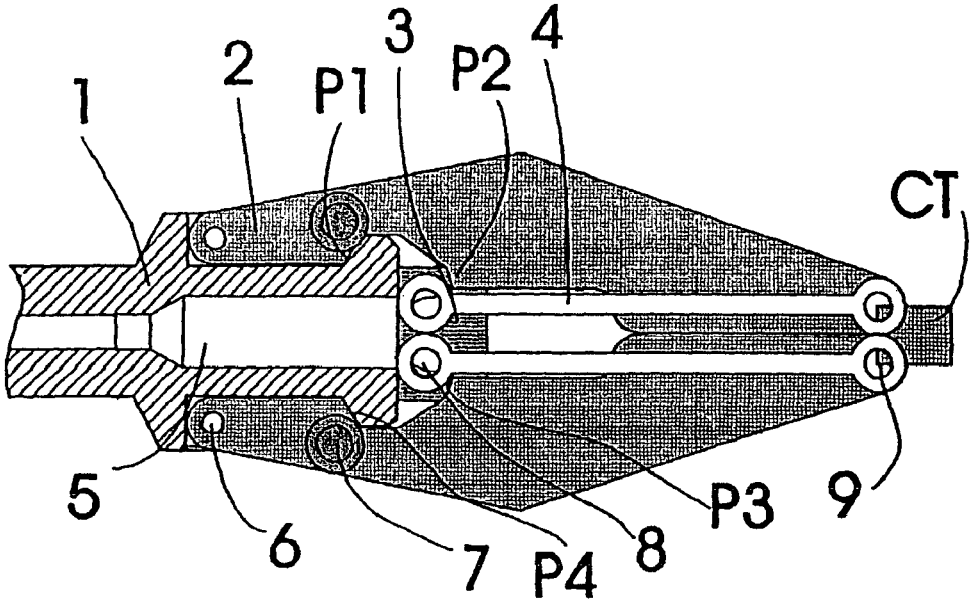
FIG. 1 shows a preferred embodiment of the recoil control device at complete rest or in passive attitude. The device comprises two inertia blocks and can be used in particular with a heavy automatic firearm.

Whether for smaller caliber handguns or rifles, in other words pistols, machine pistols and assault rifles, or for the preferred embodiments of heavy caliber rifles, machine guns, or cannons, the present invention advantageously reduces the consequences of recoil and/or eliminates, for all practical purposes, the weapon's reactive jerking and permits a more compact and lighter weapon for a given caliber ammunition.

Where heavy firearms are concerned, for example, machine guns and cannons, notably machine guns for land, water craft, or airborne platforms, the present invention enables a lighter frame for the weapon and a more compact and therefore more stowable or containable weapon. This allows moveable weapon systems to store more ammunition per sortie. Further, this invention enables a simplified construction for the base by diminishing the recoil tendency and dampening the stress acting upon the platform as a whole. This is especially advantageous when composite materials are used for the vehicles or craft carrying the weapons.

In one particular embodiment, the invention comprises a mobile breech made up of connected parts that comprise an inertia block and a bolt head. In this embodiment, the action of the mobile breech is unconventional in that it causes the inertia block to alternate out of and into alignment with the longitudinal axis of the barrel. This is contrary to the action of conventional mechanisms in which the parts making up a mobile breech move in translation along the axis of the barrel. The present invention translates forces generated by the recoil to the inertia block, M, in the instant following firing. This transfer of recoil forces from the bolt head, m, moving backward at an initial velocity, $v_i$, to the inertia block is preferably made via contact between corresponding angled surfaces of the bolt head and inertia block. The impulse transferred to the inertia block translates to a force in a direction other than along the axis of the gun barrel. The configuration of the contact surfaces allows the articulated parts to guide the inertia block. The inertia block is thus imparted with a momentum, $Mv_M$, and the velocity vector, $v_M$, has a component parallel to the axis of the gun, toward the back of the weapon, and a component perpendicular to the axis of the gun.

Terms such as "under," "over," "in front of," "the back of the gun," or "behind," "anterior," "posterior," or "transverse," are used here as somebody firing a gun would understand them, which is by reference to the longitudinal or firing axis of the barrel when the gun is held in the usual horizontal attitude. Furthermore, "firearm" as used here encompasses handguns, pistols, heavy caliber guns, rifles, sniper rifles, guns with automatic and semiautomatic action, mountable and portable cannons, cannons mounted on aircraft or naval vessels, cannons mounted on armored personnel carriers or other armored vehicles, and machine guns or cannons mounted on armored or non-armored vehicles or vessels. Also, a force component perpendicular to or lateral to the longitudinal axis of the barrel refers to a vectorial component or part of a force or momentum vector directed outside the longitudinal axis of the barrel.

Inertia block guides can be configured so that the movement of the inertia block in response to the impulse can be one of pure translation or more complex in nature. The inertia block's movement, in turn, governs the movement of the bolt head or vice versa, due to the manner of their linkage.

In one aspect, the present invention in particular allows two parameters to be varied: the ratio between the mass of the inertia block and the bolt head, and the angle between movement of the inertia block and the axis of the gun. Control or variance of such variables is not typical of present firearms technology. The recoil control device notably enables construction of automatic firearms of particular compactness for their caliber.

The positioning of the barrel of the weapon relative to the grip or stock of the weapon can effectively allow one to manage part of the recoil moment. For example, a conventional handgun grip can be placed behind a breech block of the present invention. In one embodiment of this invention, the barrel is not found above the grip, as it is conventionally in handguns, but in front of it, preferably at mid-height or at two-thirds the height of the grip. Preferably, the gun barrel axis is in line with the forearm of the person aiming the gun and not above it, the effect of which is to eliminate the upward jerking characteristic of the recoil response of conventional guns.

Other characteristics and advantages of the invention will be apparent to those skilled in the art from the description of embodiments designed specifically for handguns and of embodiments designed for heavy automatic weapons and cannons.

The following discussion addresses optional features and design factors one of skill in the art may employ in producing a heavy caliber firearm. Nothing in this discussion should be taken as a limitation to the scope of the invention and the parameters defined are merely examples of the many embodiments possible.

As the size of the ammunition increases, the percussive forces and momentum generated will also increase. Thus, the optimum weight of the bolt head and inertia block will similarly increase. One design option noted in the Figures for large caliber firearms and cannons is the use of multiple inertia blocks. These inertia blocks can be connected to the same bolt head, or each connected to a separate bolt head. The one or more guides for the inertia block(s) can be configured to move back and forth in a number of directions. In preferred embodiments, the movement traverses the longitudinal axis of the gun barrel by placement of the inertia block above the gun barrel. In another preferred embodiment, the movement of the inertia blocks extends out from the side of the gun barrel.

The initial impulse on the inertia block can be imparted by the use of gas pressure from the barrel, commonly referred to as gas injection. The expanding gases created by firing of one or more cartridges are used to pressurize a gas injection system and the pressure is selectively applied to the inertia block or blocks to cause their movement in a direction other than along the longitudinal axis of the barrel. The gas injection components can also be combined with a muzzle brake to control the pressure build-up in the gas injection system and to further address the recoil forces.

Preferably a pair of inertia blocks of substantially equal mass are oriented such that their respective movements in response to firing will be synchronized, equal in magnitude, and with corresponding but opposite components of momentum perpendicular to the longitudinal axis of the barrel. The net effect is for the perpendicular components of the momentum of the inertia blocks to cancel each other and to impose no net lateral force or agitation on the weapon. Thus, a portion of the recoil forces are transferred in a direction perpendicular to the longitudinal axis of the barrel and effectively cancelled out, thereby significantly reducing or even eliminating the component of recoil forces along the longitudinal axis of the barrel that are responsible for the reactive jerking of the weapon. The longitudinal component of the momentum of the inertia blocks can be directed forward along the axis of the barrel to counteract any residual recoil forces in the longitudinal direction. In the present invention, the mass of the inertia blocks and the magnitude of their displacement can be varied to optimally reduce the reactive jerking of the weapon as well as to vary the firing rate of the weapon.

Exemplary Embodiments in the Figures

Having generally described the invention above and the design factors one can consider, what follows refers to specific embodiments of the Figures and Examples. As noted previously, the invention is not limited by the scope of the embodiments listed, the Figures, or the Examples. Rather, one of skill in the art can employ the principles and examples to design, make, and use a number of embodiments not specifically shown here that are fully within the scope of the present invention.

FIG. 1 shows the rear of a gun barrel (1) and chamber (5). The bolt head (3) is in contact with the rear opening of the barrel.

Figure 2:
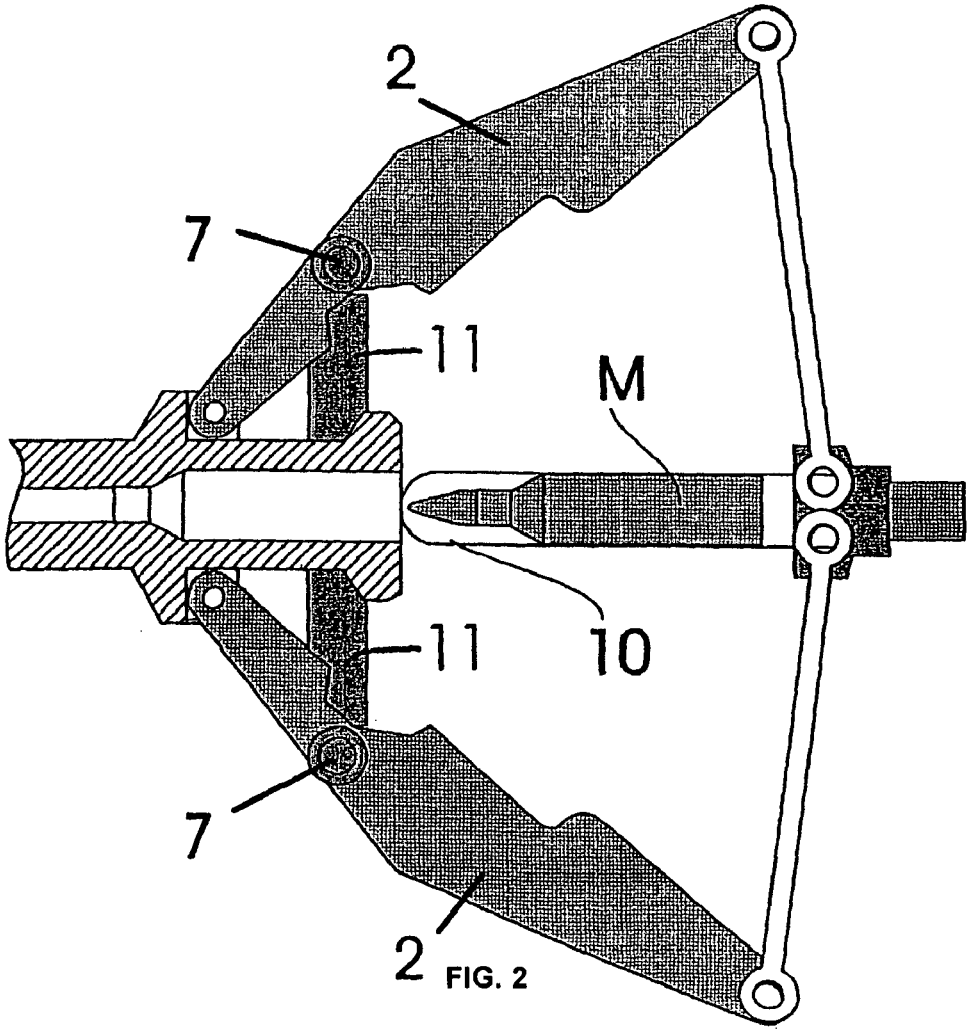
FIG. 2 shows the embodiment of FIG. 1 retracted, near the point of loading a cartridge.

FIGS. 1 and 2 show two pin rods (4), each articulated at one end to bolt head (3) by means of one of two spindles (8) oriented perpendicular to the longitudinal axis of the barrel. Each of the two pin rods (4) is articulated at its opposite end by means of a transverse spindle (9) with a first end of one of two inertia blocks (2) placed symmetrically in relation to the axis of the barrel.

As illustrated in FIGS. 1 and 2, each of the inertia blocks are articulated at their opposite ends to the chamber (5) via one of two transverse spindles (6).

The spindles (6) preferably are flexibly connected via elastic joints. Alternately, spindles (6) may be articulated with the chamber by placement in an oblong groove parallel to the axis of the barrel, which allows the spindles a limited translation in the longitudinal direction to facilitate the motion of the inertia blocks.

As shown in FIG. 1, the bolt head (3) preferably has two sloped surface portions (P3), oblique to the axis of the barrel, which are in contact with two conjugated surface portions (P2) on the inertia blocks with corresponding slopes. Each of the inertia blocks (2) preferably presents a second portion of its surface at slope (P1), which comes into contact with a portion of the surface of the gun barrel's chamber (5) affording a conjugated slope (P4), which results in a ramp providing the means for the inertia block to move out of the axis of the barrel.

Each inertia block (2) preferably bears a rotational axis about spindle (6), which is linked with a recovery mechanism (11) at spindle (7). The recovery mechanism is preferably a spring as shown, for example, in FIG. 2.

Figure 4:
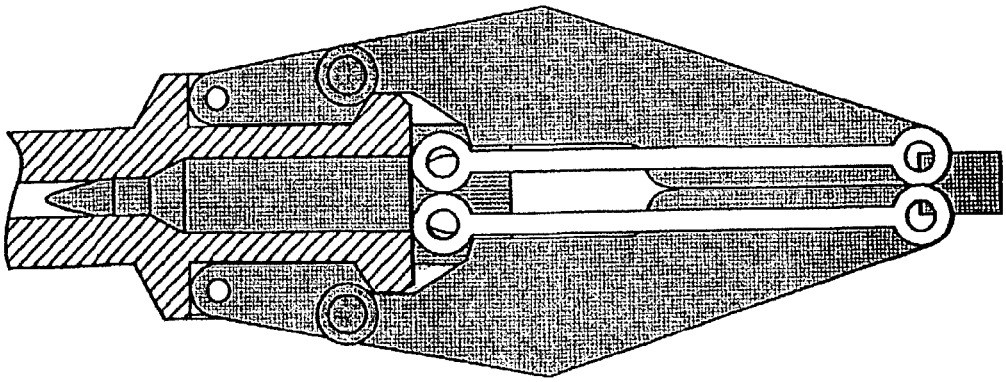
FIG. 4 shows the embodiment of FIG. 1 in a closed position with cartridge chambered.
Figure 5:
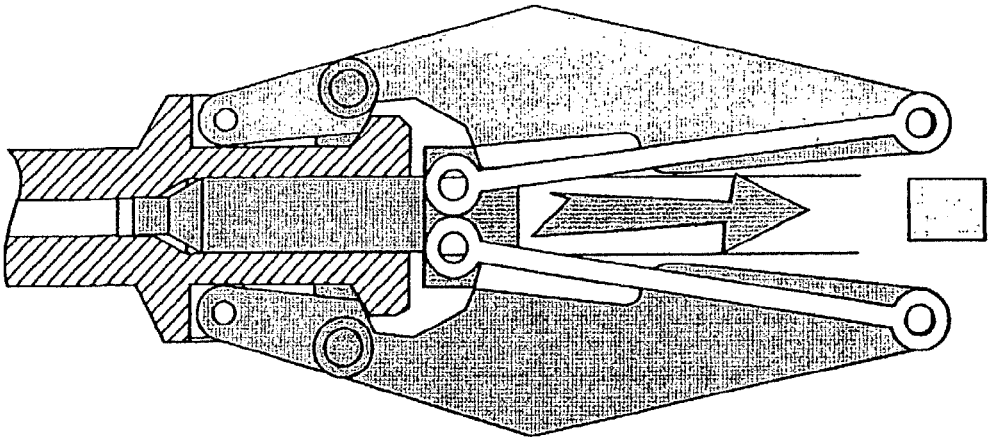
FIG. 5 shows the embodiment of FIG. 1 after firing at the start of backward movement of the bolt head.
Figure 6:
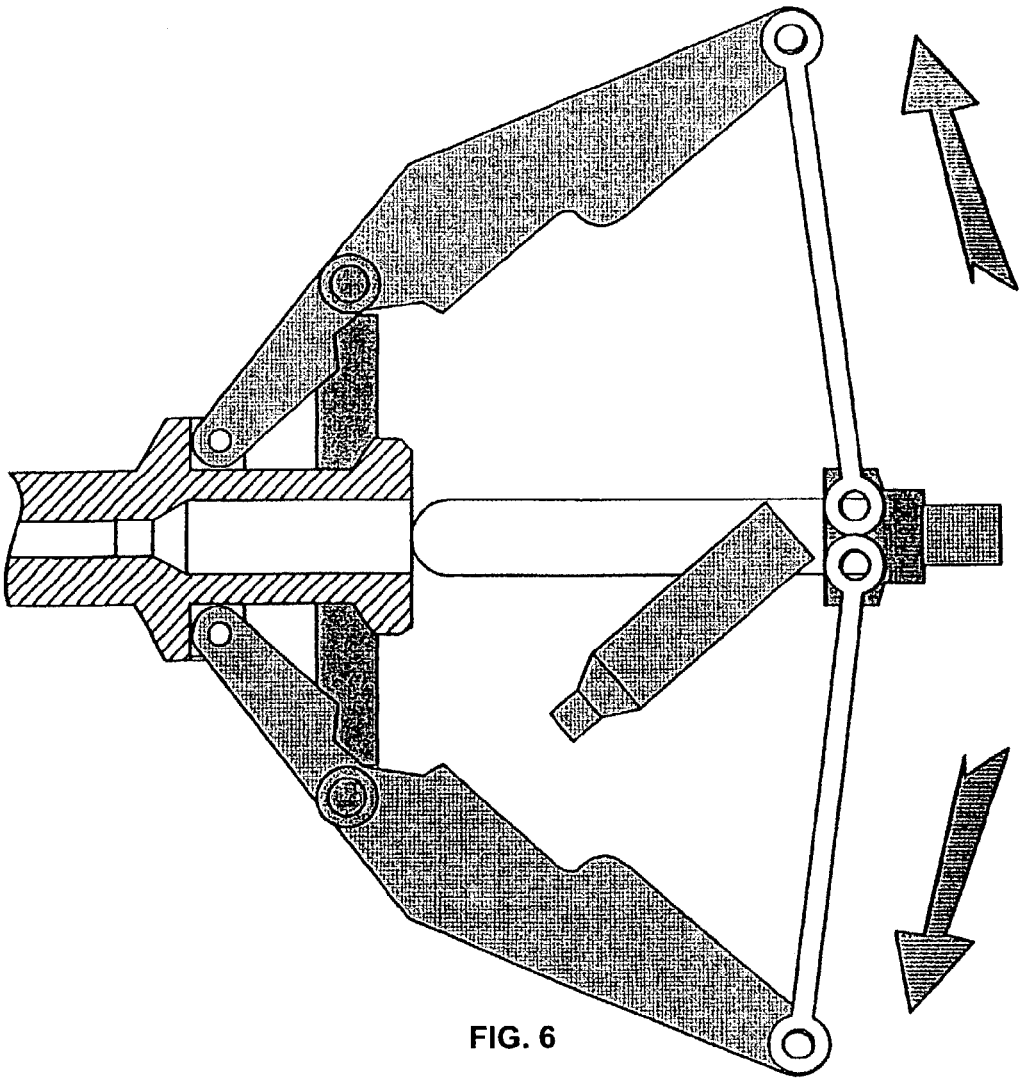
FIG. 6 shows the embodiment of FIG. 1 at the end of its movement backward, spent cartridge being ejected.

FIG. 4 shows a cartridge in the chamber ready to fire. The firing mechanism itself is not shown for simplicity. Immediately after firing, the bolt head (3) is forced backward by the base of the cartridge M, as shown in FIG. 5. The slopes (P3) at the bolt head (3) push the two inertia blocks (2) having slopes (P2). The blocks themselves exert force through slopes (P1) acting in contact with slopes (P4) on the chamber of barrel (1). Under the foregoing forces, the inertia blocks (2) translate slightly backwards, within the limit of play of the spindles (6), as seen in FIG. 5. This translation combines with and leads to two divergent rotational movements about the same spindles (6), as shown in FIG. 6. The outward motion of inertia blocks (2) forces a backward translation of bolt head (3) along the axis of the barrel via pin rods (4), which leads to the ejection of the exploded shell. Pin rods (4) function to pull and push the bolt head (3) in an alternating movement fundamental to the mechanism. The spindles (9) of the pin rods (4) preferably are attached to inertia blocks (2) via flexible joints or in oblong grooves to facilitate function appropriate to ammunition diameter. A longitudinal guide-track (10), which lines-up, as shown in FIG. 2, with the opening of an ammunition clip or magazine, completes the guidance of the bolt head (3).

The mechanism for extracting and ejecting the empty cartridge case M, not shown, may be of any design known in the art. An electromechanical or electropneumatic or other suitable triggering mechanism, CT, to govern the triggering or blocking functions, may be positioned at the rear extremity of the track for the bolt head. When the bolt head (3) reaches the end of its rearward movement, the mechanism is in the open position as shown in FIGS. 6 and 2. The pin rods (4) are in mechanical opposition, inducing a blocking of the movement, the return spring (11) being under tension. The bolt head is thus restrained from returning to the pre-firing position under the influence of recovery mechanism (11). Release of the mechanism is governed by an impulse generated by triggering mechanism CT that may consist of no more than a simple force exerted for a few millimeters at the back of the bolt head (3) in order to displace pin rods (4) forward from their locked position. Once the pin rods (4) are unlocked, the inward force exerted on inertia blocks (2) by the recovery mechanism acts through pin rods (4) to move the bolt head forward towards its pre-firing position.

FIG. 2 shows the succeeding cartridge at the point of being loaded.

Figure 3:
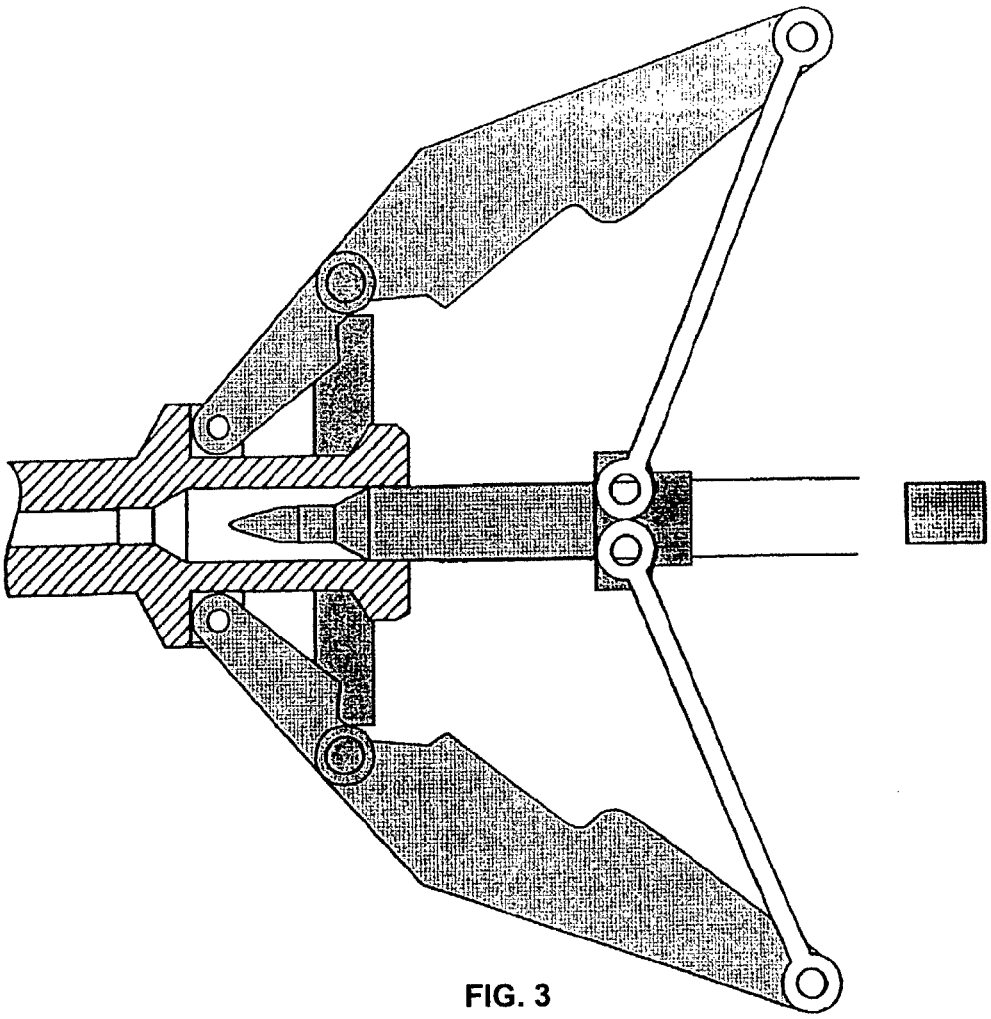
FIG. 3 shows the embodiment of FIG. 1 in the process of loading a cartridge.

FIG. 3 shows the return forward of the bolt head under spring tension. Its movement, in the usual manner, pulls the cartridge into the chamber as shown in FIGS. 3 and 4.

The triggering mechanism CT for the return movement forward of the bolt head enables precise, efficient control of the firing rate. Similarly, once propelled by the initial impulse given by the bolt head, the inertia blocks (2) pivot about the spindles (6), linked with the chamber (5).

A further advantage of the present invention is derived from the simplicity of its design, which reduces weight. The embodiment of FIGS. 1-6 further enables a considerable weight reduction by rendering superfluous most of the parts customary to the frame of a gun, which, in conventional blowback mechanisms, provide for guidance. It facilitates thus a "frameless" heavy weapon, which, for certain firearms, notably those on airplanes, provides a considerable benefit.

It should also be noted, as in FIGS. 2 to 6, that the flexing of the inertia blocks occurs in symmetry, with the inertia blocks in counter-torque and synchronized, to prevent agitation of the gun frame.

Figure 7:
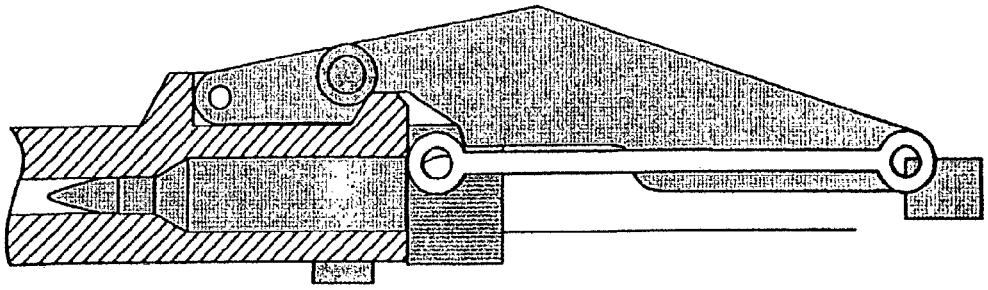
FIG. 7 shows another preferred embodiment of the recoil control device, in this case with a mechanism having only one inertia block.

FIG. 7 shows another preferred embodiment of the recoil control device. Here, the mobile breech has only one inertia block (2) and only one pin rod (4) attached to the bolt head (3). The linkages for bolt head, pin rod, inertia block and rear section of the gun barrel are identical to the embodiment of FIGS. 1-6. The action is also the same except that the return spring acting on the inertia block is fixed at its other extremity to the back of the barrel and not to a second block. This variant is suitable for a military rifle and machine gun. The recoil control device is placed in the weapon so that the inertia block rotates vertically. The inertia block therefore extends downward in response to the firing of a round to counteract recoil forces. Alternately, the gas injection system described above can be applied to a single inertia block system.

Figure 8:
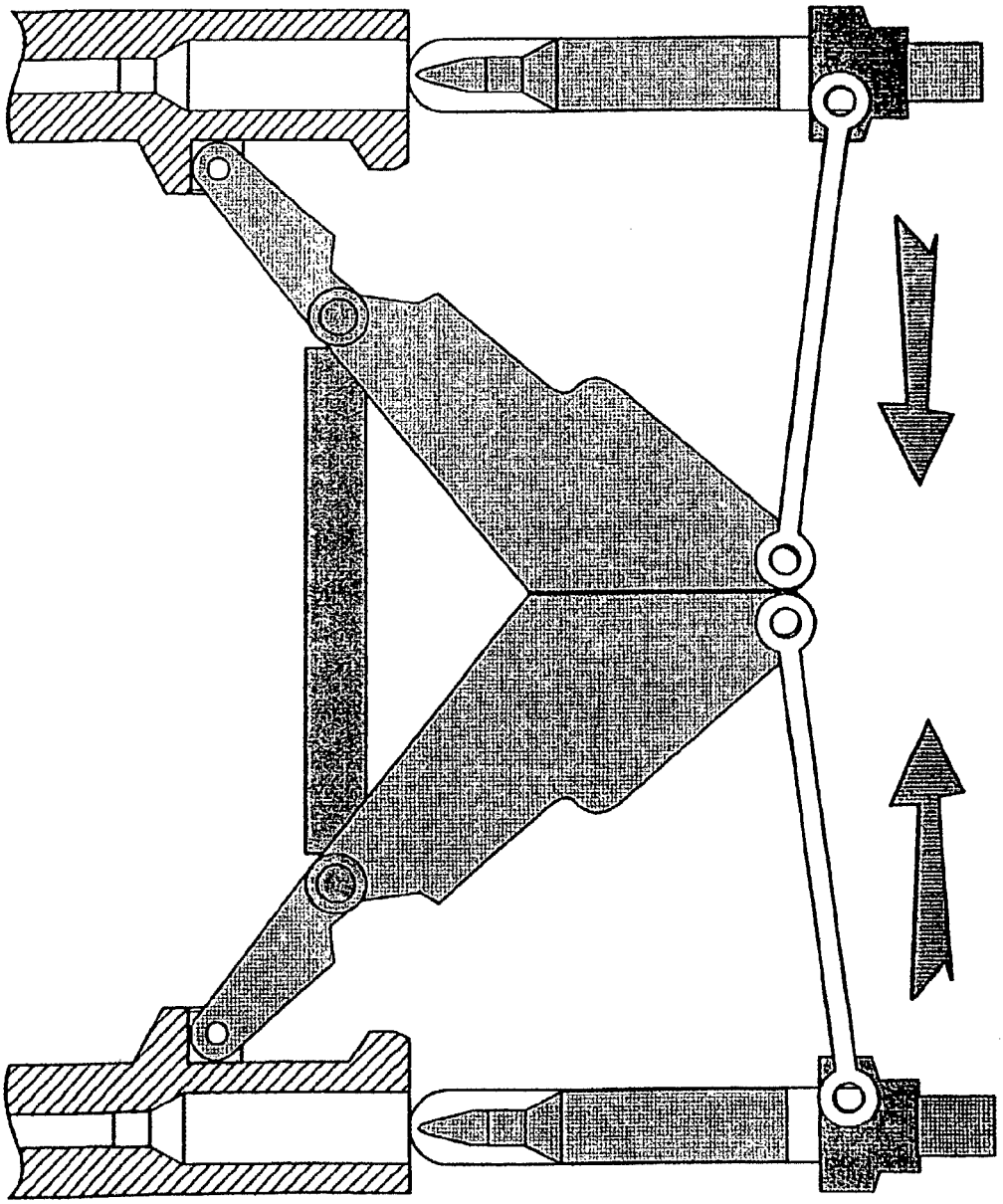
FIG. 8 shows another preferred embodiment of the recoil control device, the mechanism engineered for a twin-barreled gun.

FIG. 8 shows another preferred embodiment of the recoil control device, in this case applied to a twin-headed firearm. Each of the barrels has a moment control mechanism substantially similar to the one shown in FIG. 7. Movement by the two inertia blocks following firing is one toward the other, and they are linked by a common reset spring that, in this variant, resists compression instead of extension. Synchronization for the firing of the two barrels is achieved by unified electromagnetic control of the two triggering mechanisms CT.

Figure 9:
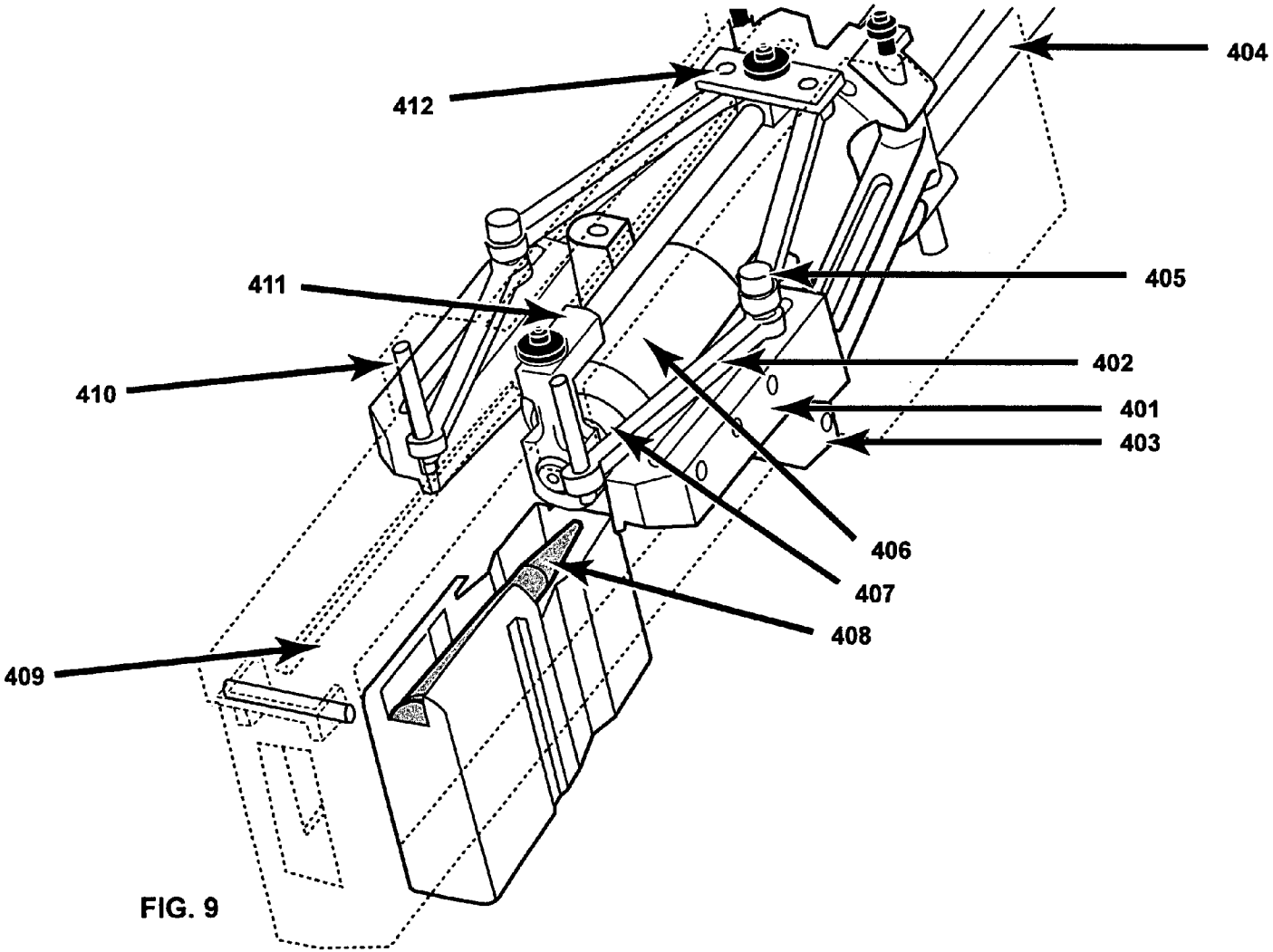
FIG. 9 shows another preferred embodiment of a single barrel firearm equipped with the recoil control device of the present invention with gas injection in breech closed position.
Figure 10:
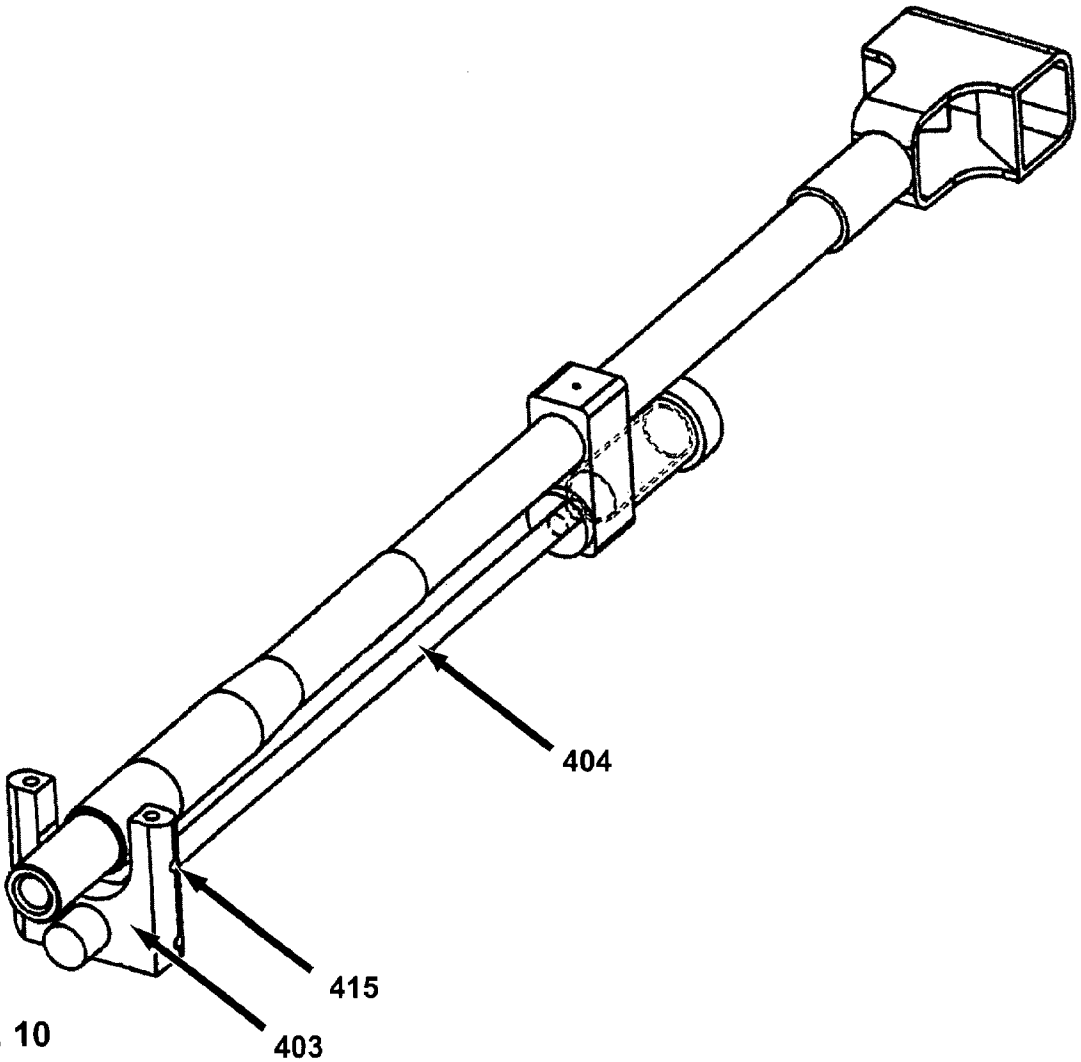
FIG. 10 shows the gas injection system of the embodiment of FIG. 9.
Figure 11:
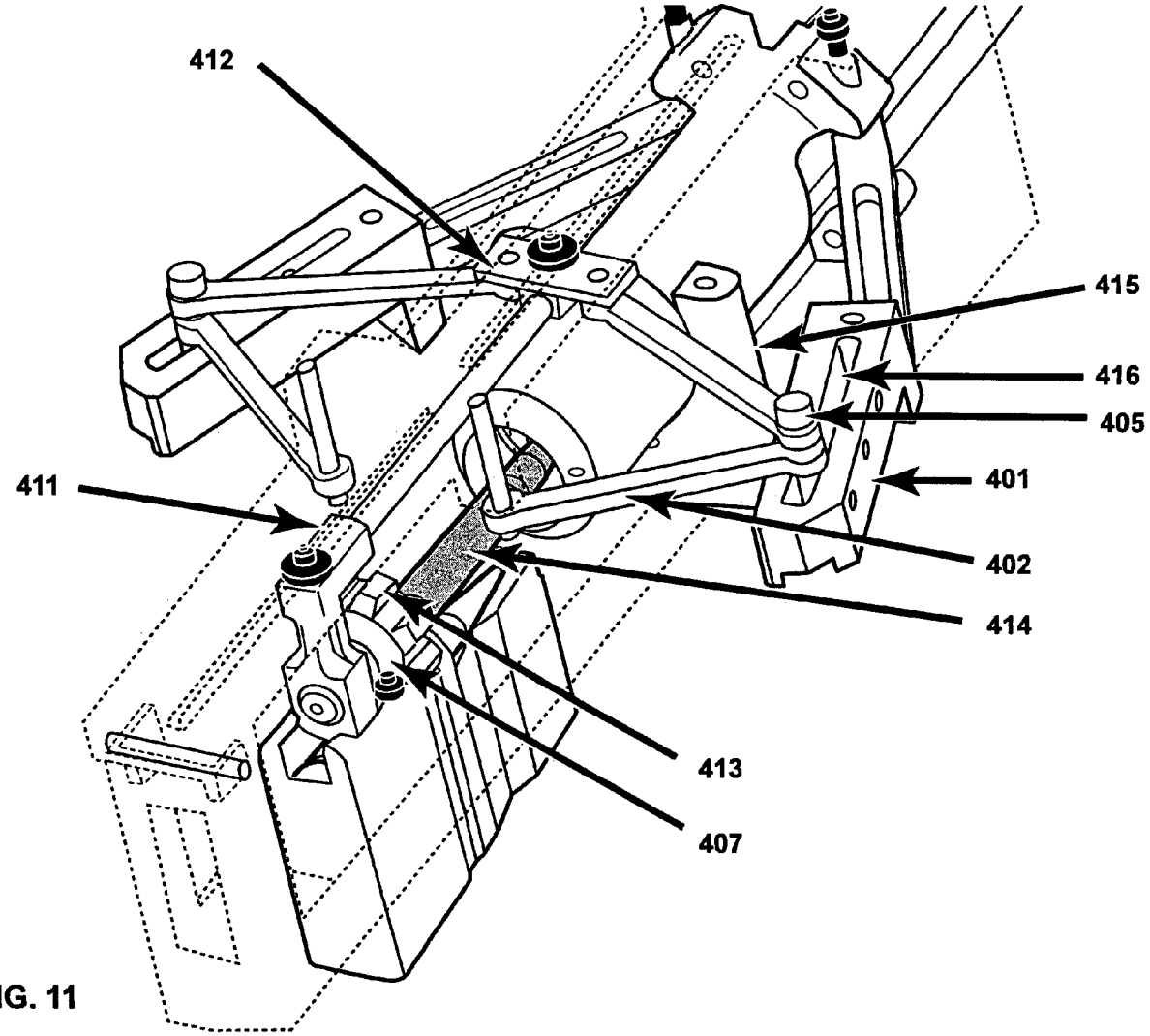
FIG. 11 shows the embodiment of FIG. 9 with a spent cartridge being ejected.

FIGS. 9-12 show a partial cutaway view of an optional heavy caliber embodiment. Here, inertia masses (401) are placed on each side of the locking cylinder (406), where cartridge is chambered. In FIG. 9, cartridge is chambered and firearm is loaded. As firing mechanism (not shown here) fires a round, gas from the barrel returns through the gas injection system and tube (404) and gas distributor (403). FIG. 10 shows a simplified view of the parts of the gas injection system for the embodiment of FIG. 9. An aperture (415) directs gas against inertia masses (401) to initiate outward movement. Rods (402) connecting inertia masses to the transporter assembly at front (412) and back (411), cause the transporter assembly to move back. The transporter assembly moves back and forth along top rail (409) during operation and is linked to bolt head (407). Cams on the locking cylinder (not shown) are contacted by one of inertia mass (401) to rotate the locking cylinder and release bolt (407) from locking cylinder (406). The locking cylinder may also be characterized as a locking spool and the terms are used interchangeably herein. Pins (410) link rods (402) to top rail (409). As the inertia masses continue their outward movement, locking cylinder (406) rotates 1/7 of a turn to release the bolt and cartridge case. Pins (405) allow rods (402) to slide through slots (416) in inertia masses. The inertia masses continue outward movement to maximum extension of the rods linking them to the bolt head (407) to cause extraction of cartridge case (414) through an automatic ejector (not shown). Movement of inertia masses, controlled through rods and transporter assembly, redirects recoil forces and diminishes recoil amplitude. Rods (402) move through a position perpendicular to the longitudinal axis of the barrel. A return spring or device (not shown) forces the movement of the bolt head forward, causing pins (405) in slots (416) to force inertia masses back inward. A cam (413) on the bolt head engages the next cartridge from magazine (417) as the bolt moves forward. As the inertia masses continue moving inward, the cartridge is placed into locking cylinder. A cam on the locking cylinder (not shown) is contacted by an inward moving inertia mass, causing the locking cylinder to rotate and align cams on the locking cylinder to cams (413) on the bolt. The bolt moves into its forward-most position and the inertia masses continue inward movement. The next round is now chambered and ready to fire.

FIG. 9 shows the round fully chambered, the bolt head (407) in the forward position, and the locking cylinder (406) in the locked position. In this embodiment, the direct transfer of recoil forces from the bolt head via the linkages to the inertia block does not control the movement of the inertia blocks. Rather, the bolt head is initially locked in the breech-closed position by a breech locking mechanism (406). After firing of the chambered round, the bullet is forced along the barrel by the expanding gases from firing. The bolt head's initial translation backward is partly caused by the recoil force generated by the firing of the round, under gas compression, to the degree that such pressure and the corresponding energy have not been diverted by the gas induction system to induce movement of the inertia masses. Essentially, however, the bolt head's translation is driven by the rotation of inertia blocks and the pin rod connections.

Unlike the embodiment of FIGS. 1-6, the cartridge is initially restrained from aftward movement along the axis of the barrel by the breech locking mechanism (406). As a result, the exhaust gases will generate a considerable pressure in the barrel (to a maximum of approximately 6,000 bars for a .50 caliber cartridge). These gases will pressurize the gas injection system through gas tube (404), which optionally can be isolated from the barrel to retain the gas pressure and to permit its use to move the inertia blocks. Gas pressure preferably is applied to each of the two inertia blocks to start them rotating substantially simultaneously in opposing directions with a component perpendicular to the axis of the gun barrel and outward from the gun barrel. The gas pressure applied to the inertia blocks is preferably between about 300 and about 400 bars. This effectively redirects the recoil forces generated by the expanding gases in a direction transverse to the axis of the barrel as described above.

The bolt (407) preferably is connected to a transporter assembly that travels along a top tray/guide (409), which constrains the back and forth movement of the bolt head in response to the firing of one or more cartridges to be substantially in line with the longitudinal axis of the barrel. Each inertia block (401) is connected to the transporter assembly (407) by a rod (402). In this embodiment, each rod (402) is connected to the inertia blocks (401) by a transverse spindle, which slides in a slot (416) in inertia blocks (401). Each inertia block preferably also is connected to the frame of the weapon by a second rod.

Figure 12:
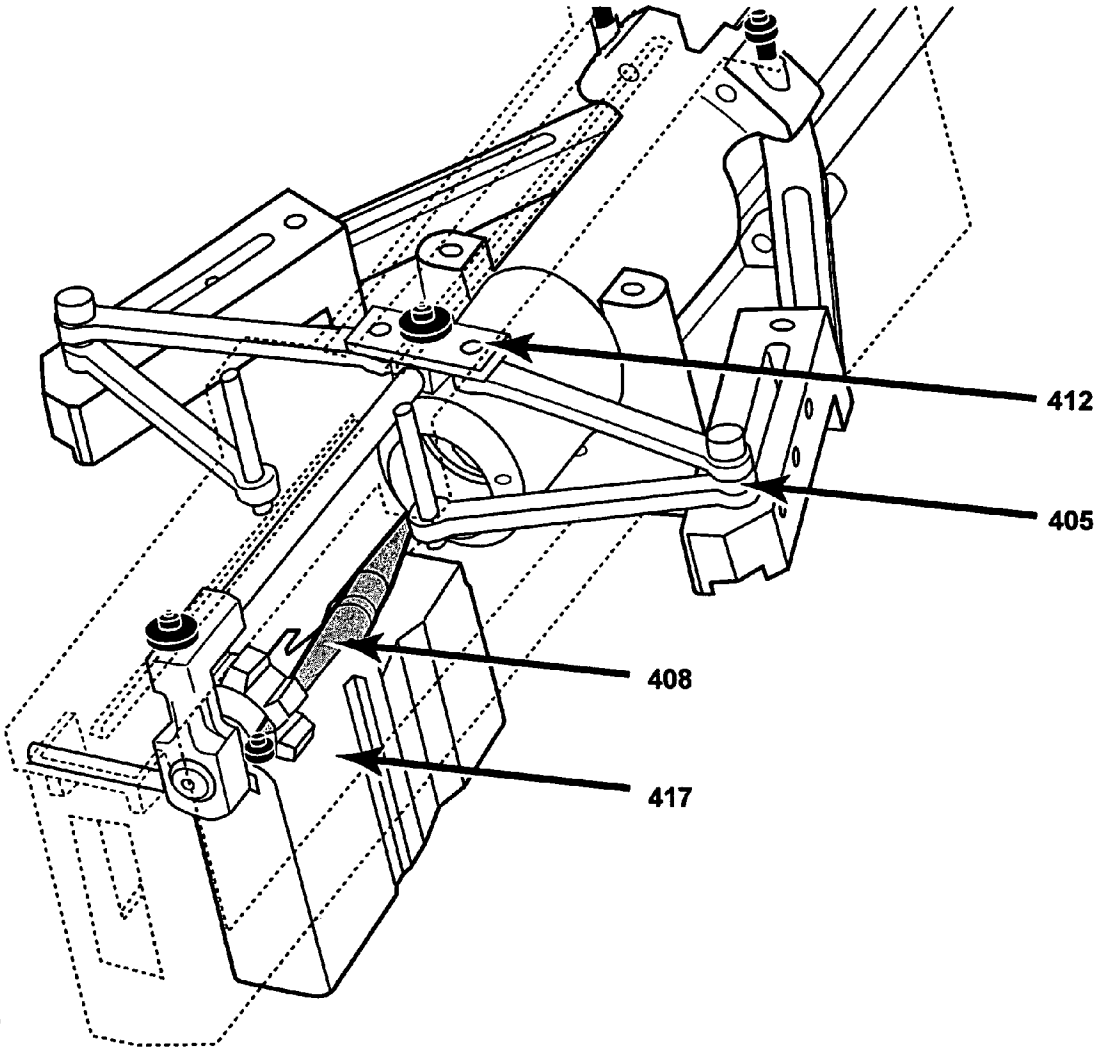
FIG. 12 shows the embodiment of FIG. 9 with a new round being chambered.

FIG. 12 shows the embodiment of FIG. 9 with a new cartridge being chambered. As the bolt head (407) chambers a fresh cartridge, the inertia blocks are forced inward by a recovery mechanism, not shown, which restores the bolt head (407) to its forward position. As the inertia blocks (401) move inward, they cause the breech locking mechanism to rotate to the locked position.

Figure 13:
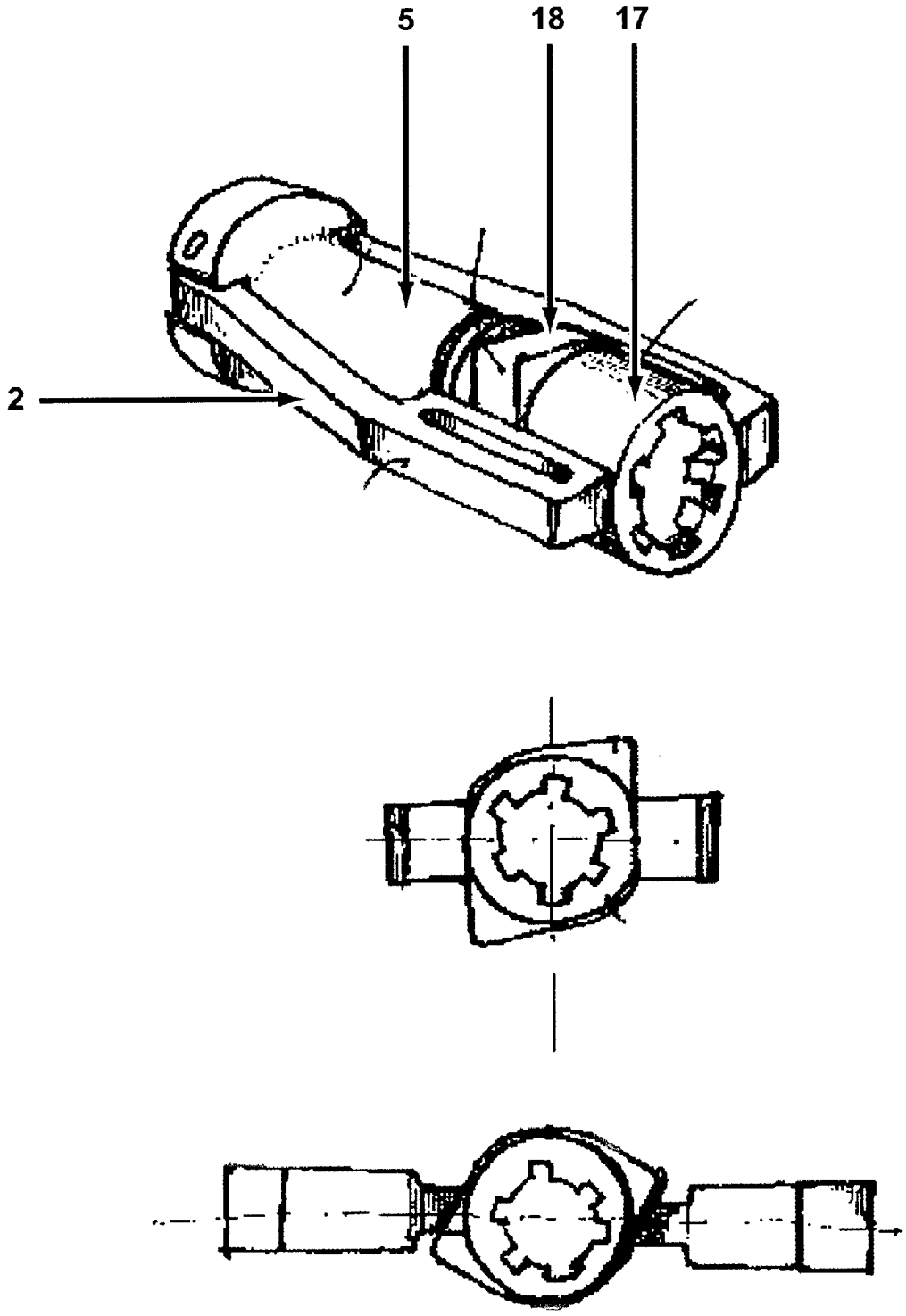
FIG. 13 shows a preferred embodiment of a breech locking mechanism for use with the embodiment of FIG. 9.
Figure 18:
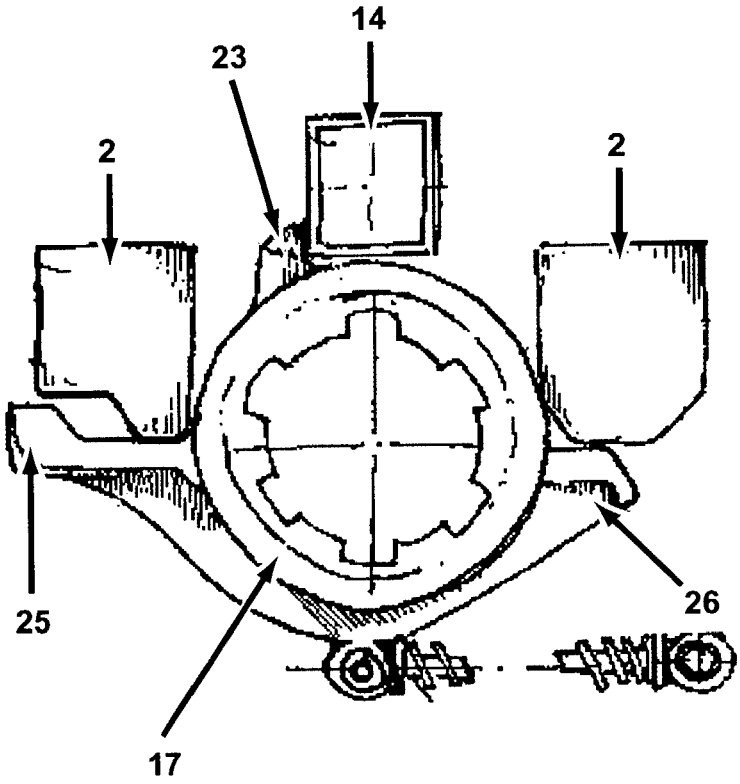
FIG. 18 show another preferred embodiment of a breech locking mechanism for use with the embodiment of FIG. 9.
Figure 18:
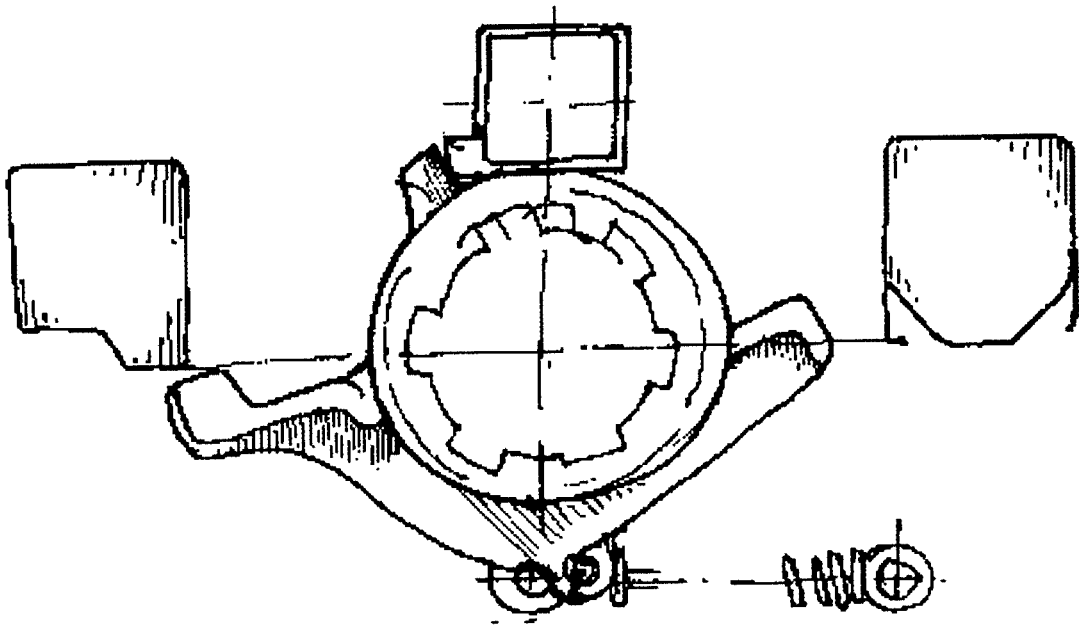

FIG. 13 shows a preferred embodiment of a breech locking mechanism for use with the embodiment of FIG. 9. In this embodiment, the breech locking mechanism comprises a locking spool (17) and a cam (18). The locking spool (17) preferably is a generally cylindrical tube with tenons for engaging corresponding tenons on bolt head (3) when in the locked position. To lock the breech locking mechanism, the locking spool is rotated to align the tenons on the locking spool with corresponding tenons on bolt head (3). The locking spool (17) preferably has 7 tenons and is preferably rotated 1/7 of one turn to engage the corresponding tenons of the bolt head (3). The locking rotation of the locking spool is initiated when the inertia blocks (2) are forced inward by the recovery mechanism (11). As the inertia blocks (2) move inward, the transporter assembly (14), as shown in FIG. 18, moves forward under the influence of its linkage to inertia blocks (2) via pin rods (4). The locking spool is in the unlocked position, permitting the bolt head (3) to move forward and the tenons on bolt head (3) to slide between the tenons on locking spool (17) as the bolt head (3) approaches its forward position. As the inertia blocks (2) are returned to their pre-firing position, they strike extensions of cam (18) forcing it, and locking spool (17) to rotate 1/7 of one turn to the locked position.

Figure 14:
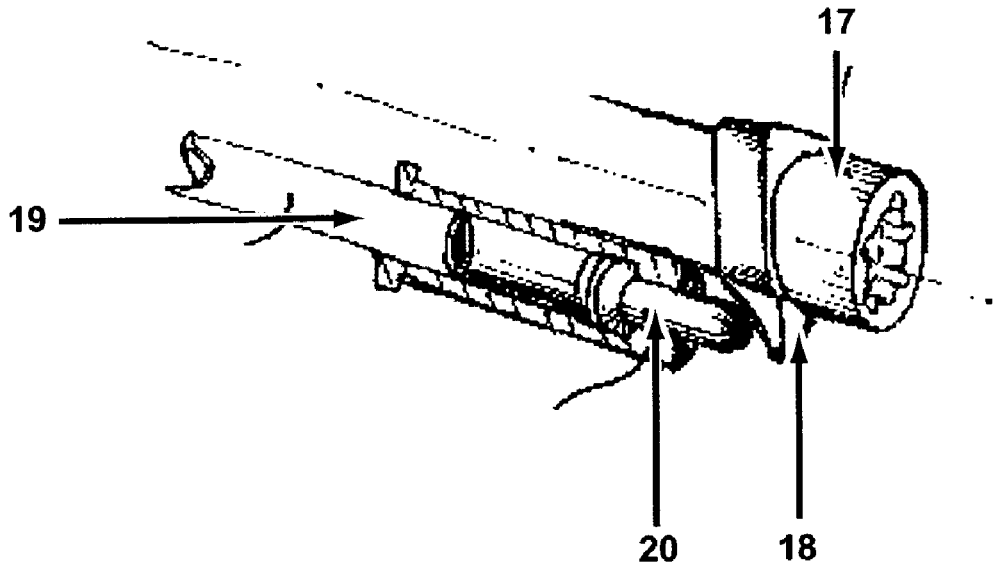
FIG. 14 shows a gas injection system for actuating the breech locking mechanism of the embodiment of FIG. 13.
Figure 14:
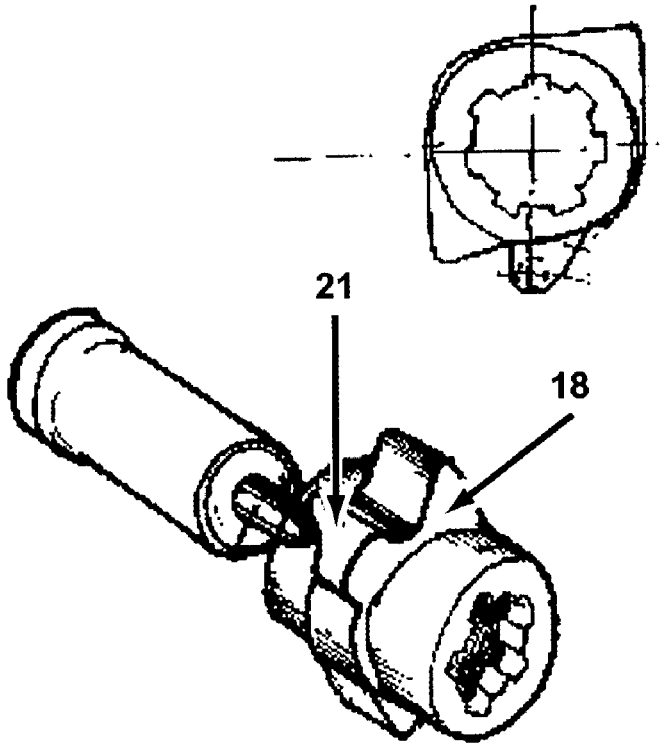

When a round is fired, the expanding gases of firing pressurize the barrel and gas injection mechanism including gas tube (19), as shown in FIG. 14. This forces forcing piston (20) to strike opening cam (21), rotating locking spool 1/7 of a turn to unlock the locking spool and to permit the bolt head to move backward. The rotating cams (18) provide an impulse to inertia blocks (2), pushing them outward as shown in the bottom diagram of FIG. 13. This causes a lateral transfer of momentum out of the longitudinal axis of the barrel. As described for the embodiment of FIGS. 1-6, the inertia blocks are preferably of substantially equal mass and imparted with substantially equivalent components of lateral momentum, which tend to cancel each other to prevent undesirable agitation of the weapon. The outward movement of inertia blocks (2) causes the transporter assembly to force the bolt head backward, to eject the spent cartridge, and to chamber a fresh round, as shown in FIGS. 9-12.

Figure 15:
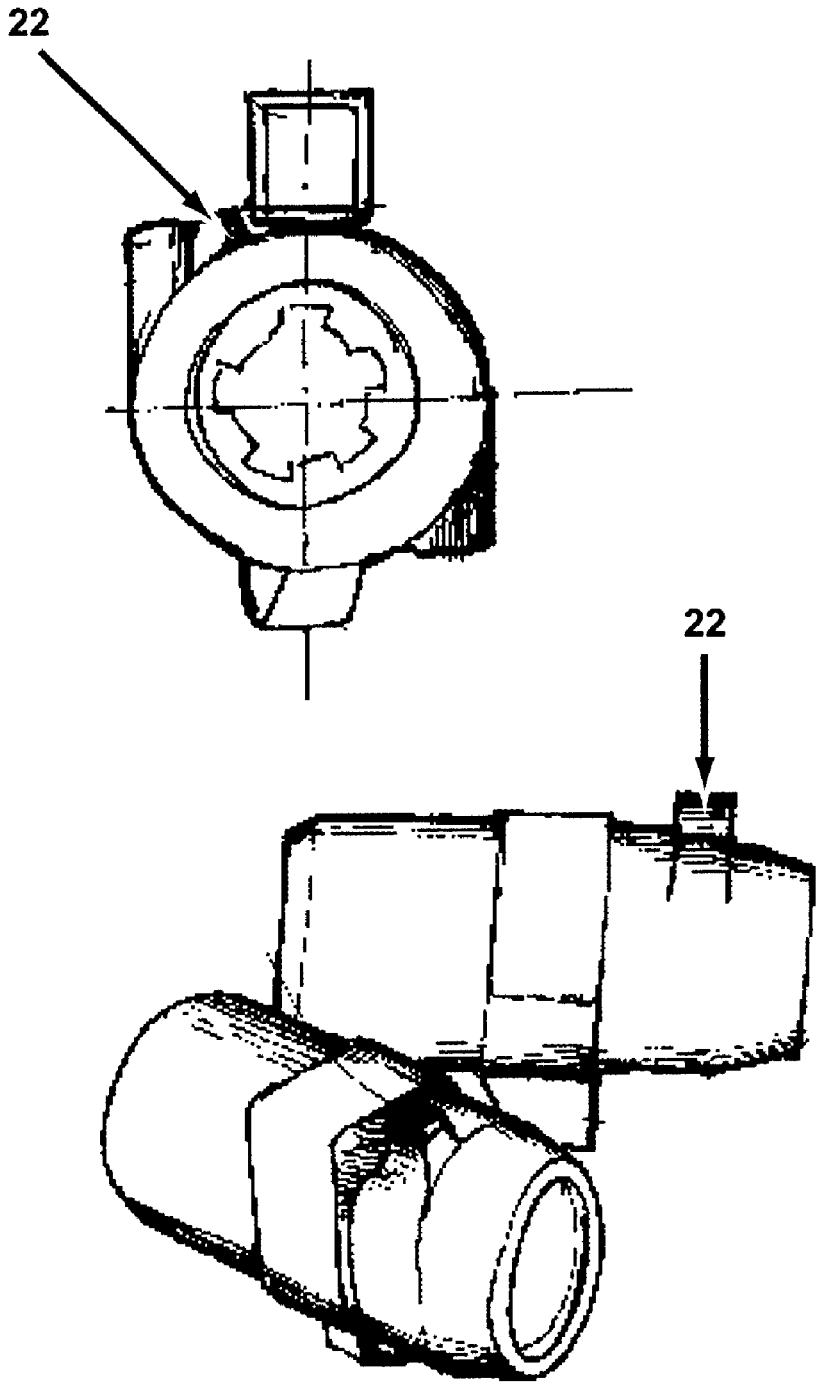
FIG. 15 shows the breech locking mechanism of FIG. 13 including the transporter assembly and an optional cocking catch.
Figure 16:
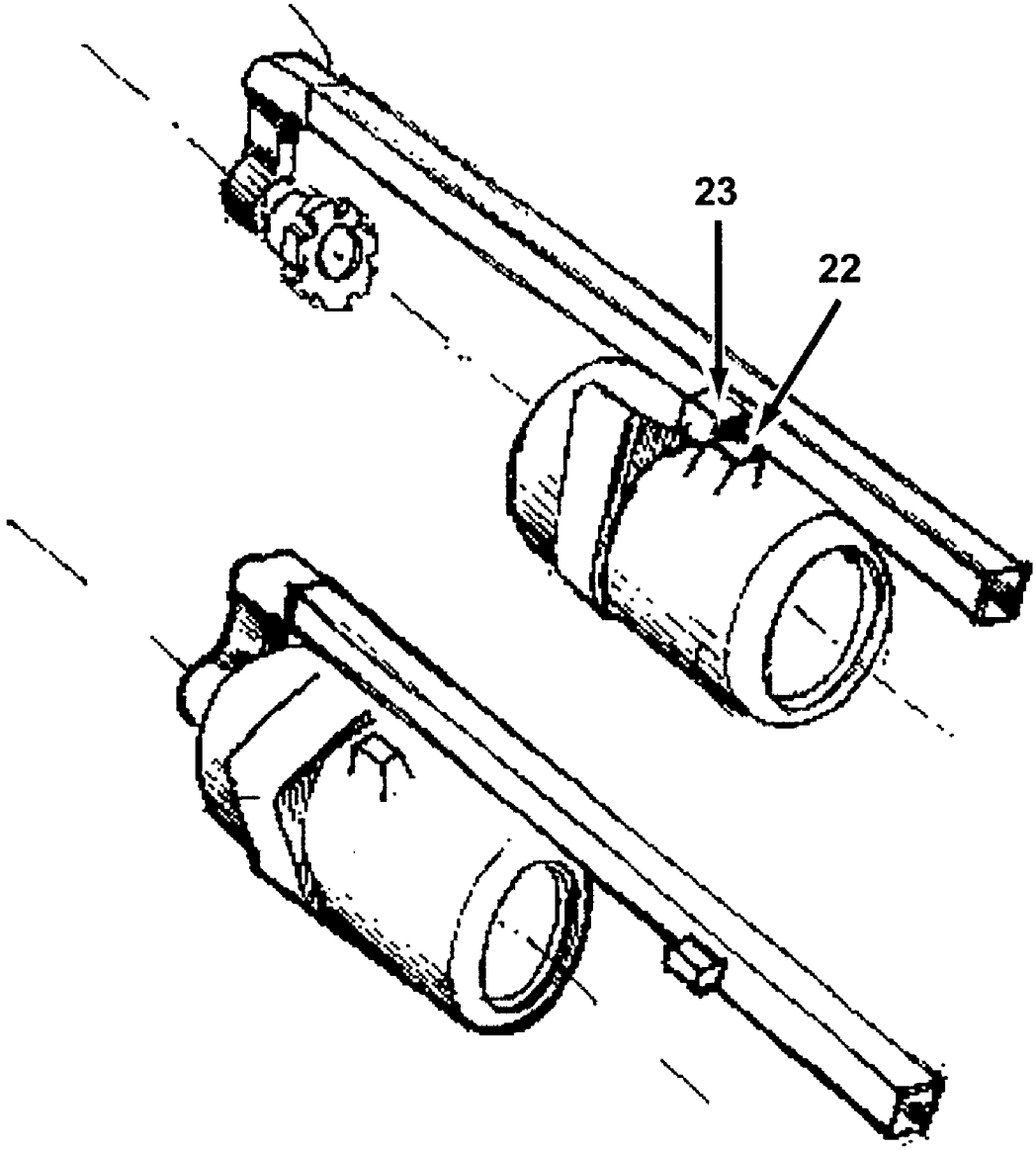
FIG. 16 shows the motion of the bolt head and transporter assembly in conjunction with the breech locking mechanism and the cocking catch.

FIG. 15 shows the breech locking mechanism of FIG. 13, including the transporter assembly and an optional cocking catch (22). When the transporter assembly is in its rearward position, the cocking catch (22) engages tenon (23) to hold the bolt head in its rearward position, as shown in FIG. 16.

Figure 17:
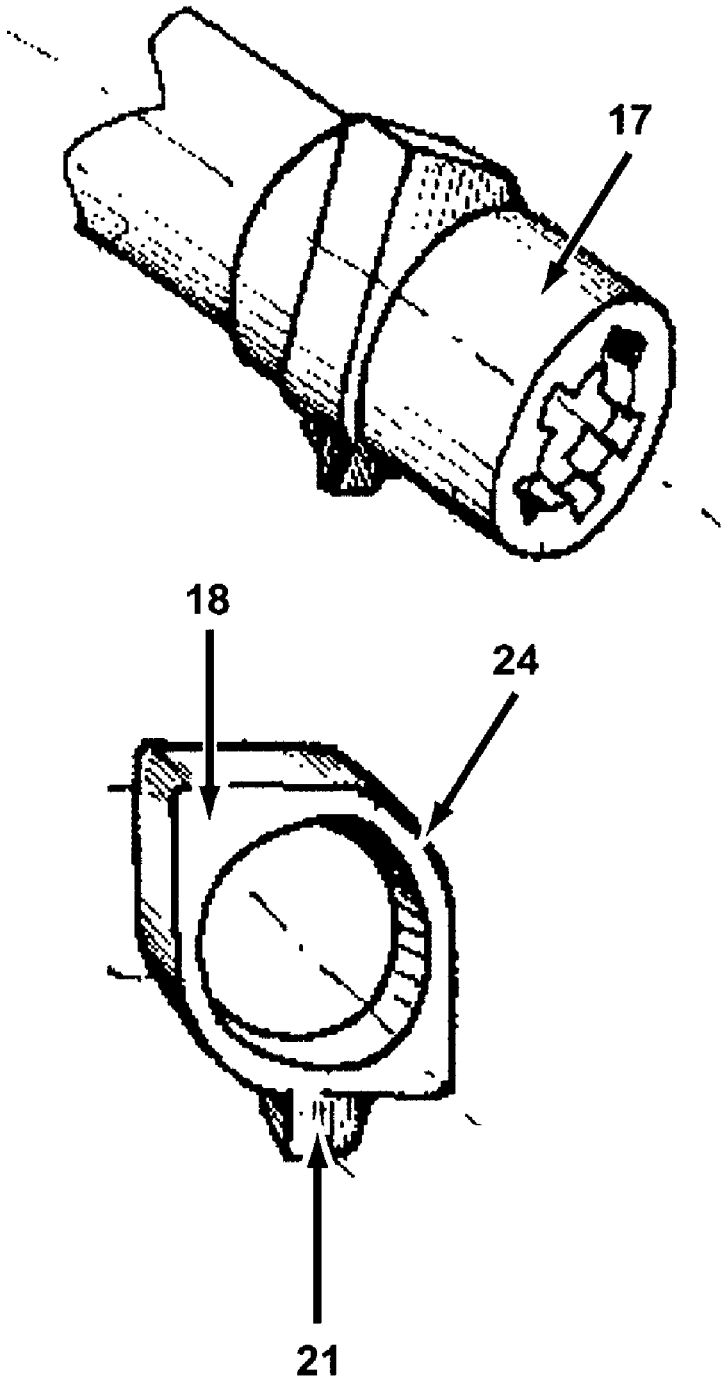
FIG. 17 shows another embodiment of a breech locking device for use with the embodiment of FIG. 9.

FIG. 17 shows an expanded view of the breech locking mechanism of FIG. 13. The locking cam may be part of an unlocking ring (24). This unlocking ring may include both the opening cam (21) to unlock the breech locking mechanism and opening cams (18) to provide an impulse to the inertia blocks (2) to transfer recoil forces out of the axis of the barrel and to provide the motive force for the ejection and loading cycle through linkages with the transporter assembly (14).

FIG. 18 shows another preferred embodiment for a breech locking mechanism for use with the embodiment of FIG. 9. In this embodiment, the gas pressure from the gas injection system is applied to the inertia blocks (2) to transfer a momentum impulse with a lateral component to the inertia blocks (2). As the inertia blocks (2) rotate outward from the barrel in a fashion similar to that described for the embodiment of FIGS. 1-6, at least one inertia block (or a tenon or element of the inertia block) will impinge on unlocking cam (25) extending from at least one side of the breech locking mechanism, causing the locking spool (17) to rotate to an unlocked position. The rotational displacement of the locking spool (17) is preferably 1/7 of a full revolution. The rotational displacement can vary from approximately 1/7 of a full revolution, depending on the spacing of the locking spool tenons and/or cams or tenons on the bolt. The arrangement or design of tenons and cams that interact between the inertia block and the locking spool (or locking cylinder) can vary. In one embodiment, for example, when the inertia block (or tenon or protrusion on the inertia block) has moved approximately 10-15 mm, it strikes the unlocking cam on the locking spool and knocks it upward. This causes the locking spool to rotate approximately 1/7 of a rotation, which causes the tenons on the locking spool to move out of alignment with the tenons on the bolt, thereby unlocking the breech locking mechanism and permitting the aftward movement of the bolt.

It should be noted that by this point in the firing cycle the bullet has left the barrel on the way to its target and the barrel is effectively depressurized prior to unlocking the breech locking mechanism. With the breech locking mechanism in the unlocked position, the bolt head (3) is permitted to move in a backward direction along the axis of the gun barrel guided by transporter assembly (14). The inertia blocks (2) are connected to the transporter assembly (14) that ensures that any aftward movement of the bolt head (3) is substantially along the axis of the barrel. The inertia blocks (2) are connected to the transporter assembly by linkages such that when the inertia blocks are forced outward by the gas pressure from the gas injection system, the transporter assembly (14) will be moved backward along the axis of the gun barrel through the linkages. This backward movement will cause the bolt head (3) also to move backward, bringing along with it the spent cartridge, which is then ejected in conventional fashion. Once the inertia blocks (2) reach their outermost position, the recoil control device is in the open position as described above wherein the rods or linkages are in mechanical opposition blocking the recovery mechanism or return spring (11) from returning the mechanism to the pre-firing position. Optionally, the cocking catch (23) may be engaged at this point to hold the mechanism in the open position. Similar to the embodiment of FIGS. 1-6, an impulse is required to release the mechanism and to allow the return springs (11) to draw the inertia blocks (2) inward toward the barrel and thereby to force the transporter assembly (14) forward, causing the bolt head (3) to chamber the next round in conventional fashion. The impulse may be provided by any electromechanical or electropneumatic triggering mechanism as described above. For example, the triggering mechanism may be a solenoid, which can be selectively energized to control the firing rate of the weapon. After the bullet is chambered, the continued inward motion of the inertia blocks impinges on the locking cam (26) of the breech locking mechanism, causing locking spool (17) to rotate into the locked position in preparation for firing of the next round.

Figure 19:
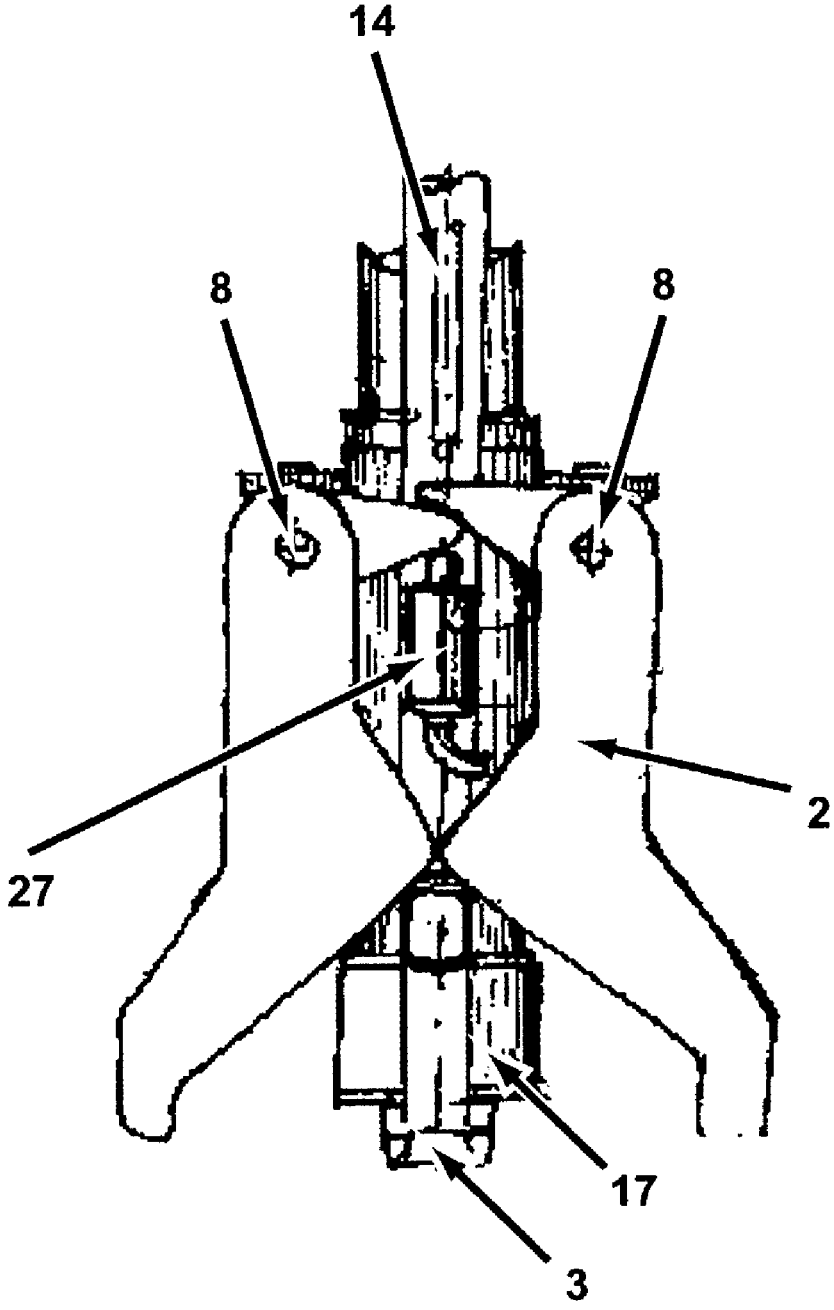
FIG. 19 shows another embodiment of a single barrel firearm of the present invention.

FIG. 19 shows another embodiment of a single barrel firearm of the present invention. The inertia blocks (2) are of a different shape from the embodiment of FIG. 9, and rotate inward towards the twin barrels about transverse spindles (8) in response to an impulse delivered by forcing piston (27). The forcing piston is driven by gas pressure from gas injection system, which is pressurized by the expanding gases of firing. Similar to the embodiment of FIG. 9, the inertia blocks (2) of this embodiment have roughly equivalent masses and receive substantially equivalent momentum impulses from the forcing piston (27). Thus, the inertia blocks (2) are imparted with nearly equivalent lateral components of momentum leading to approximately zero net lateral momentum on the firearm to prevent agitation of the firearm during firing.

Figure 20:
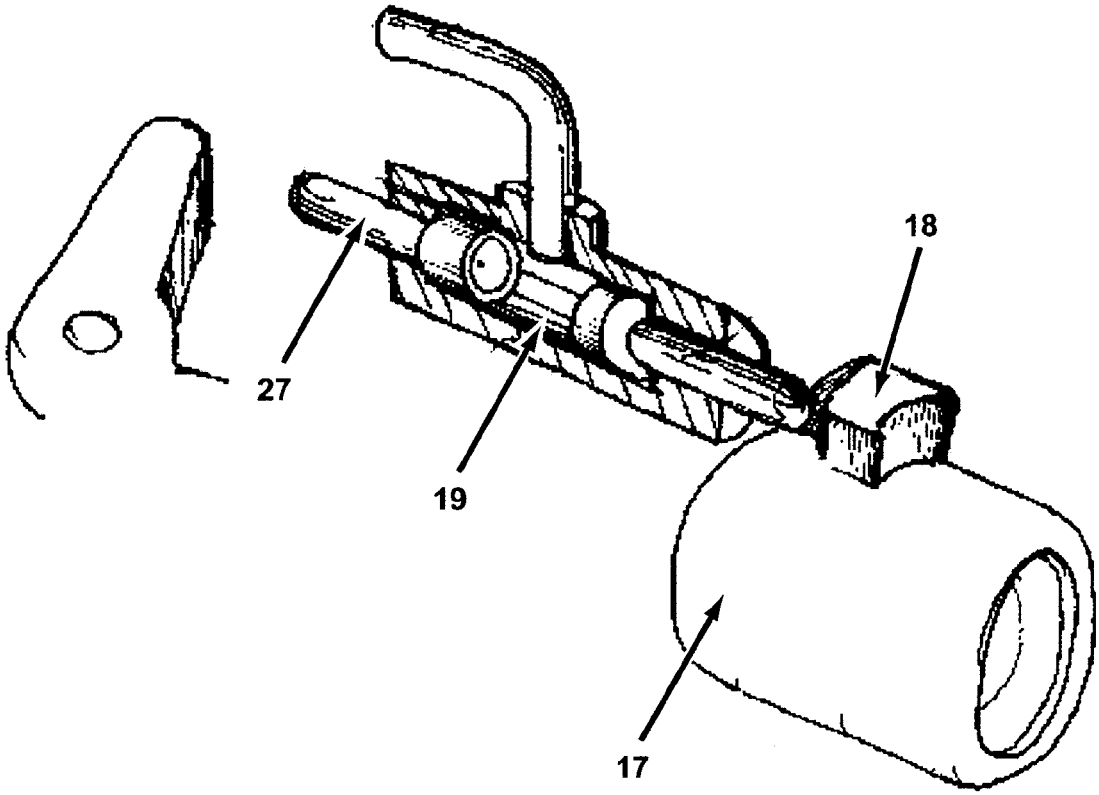
FIG. 20 shows a cutaway view of a gas injection system for use with the single barrel firearm of FIG. 19.

FIG. 20 shows a cutaway view of a gas injection system for use with the single barrel firearm of FIG. 19. The system for this embodiment is similar to that shown and described in conjunction with FIG. 14 except that the gas tube (19) transports the high-pressure gases from firing to two forcing pistons. One forcing piston (20) operates opening cam (18) to rotate the locking spool (17) to the unlocked position. The other forcing piston (27) imparts the momentum impulse to the inertia blocks (2) as described above.

Figure 21:
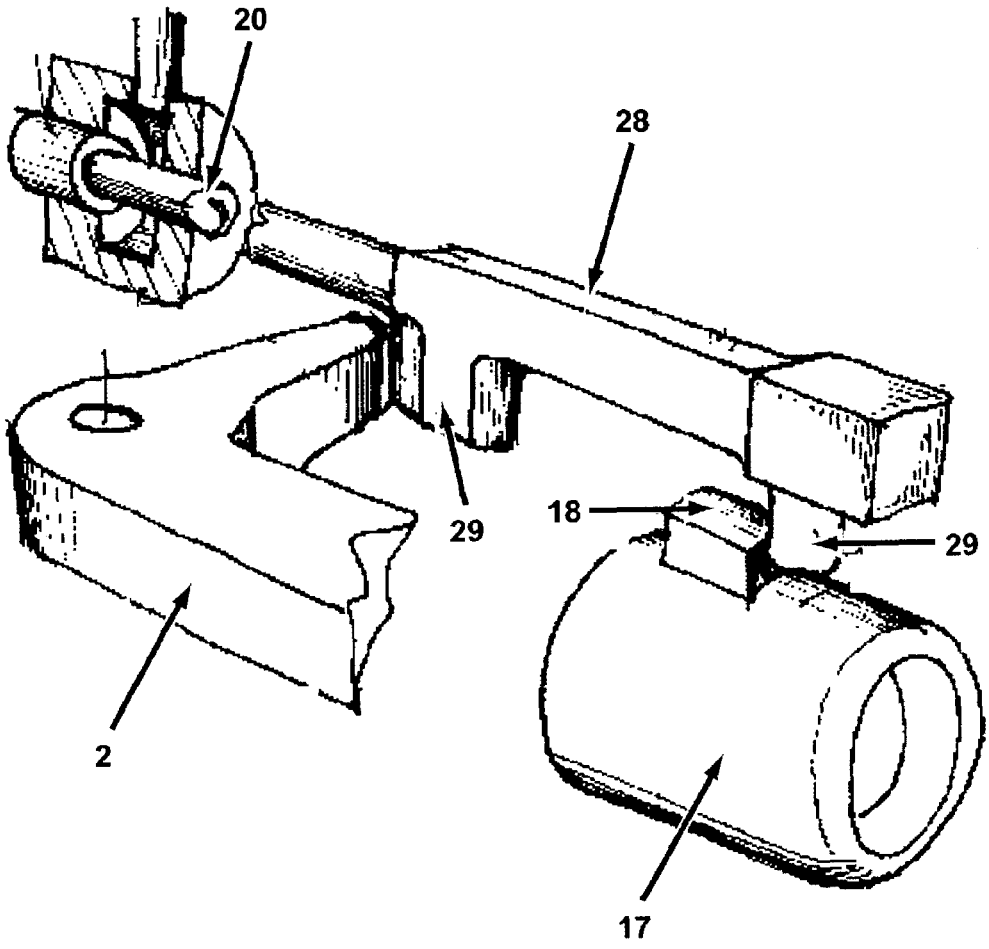
FIG. 21 shows an expanded view of the embodiment of FIG. 19.
Figure 21:
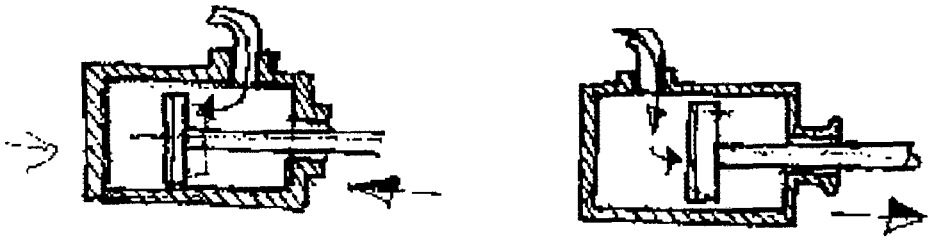

FIG. 21 shows that it is possible to use a single forcing piston (20) to simultaneously actuate the inertia blocks (2) and the locking spool (17) via operating member (28) with operating tenons (29).

Thus, a gas injection system can be used to unlock the locking spool (17) as shown in FIG. 14, with the rotation of the locking spool imparting a momentum impulse to inertia blocks (2) through opening cams (18). Alternately, the gas injection system can be used to impart an impulse to the inertia blocks (2) as shown in FIG. 18 and thereby to unlock the locking spool (17) through the inertia blocks (2) striking an unlocking cam (25). Finally, the gas injection system can be used both to impart a momentum impulse to inertia blocks (2) via forcing piston (27) and to unlock the locking spool (17) via forcing piston (20) and opening cam (18) as shown in FIG. 20 or 21.

Figure 22:
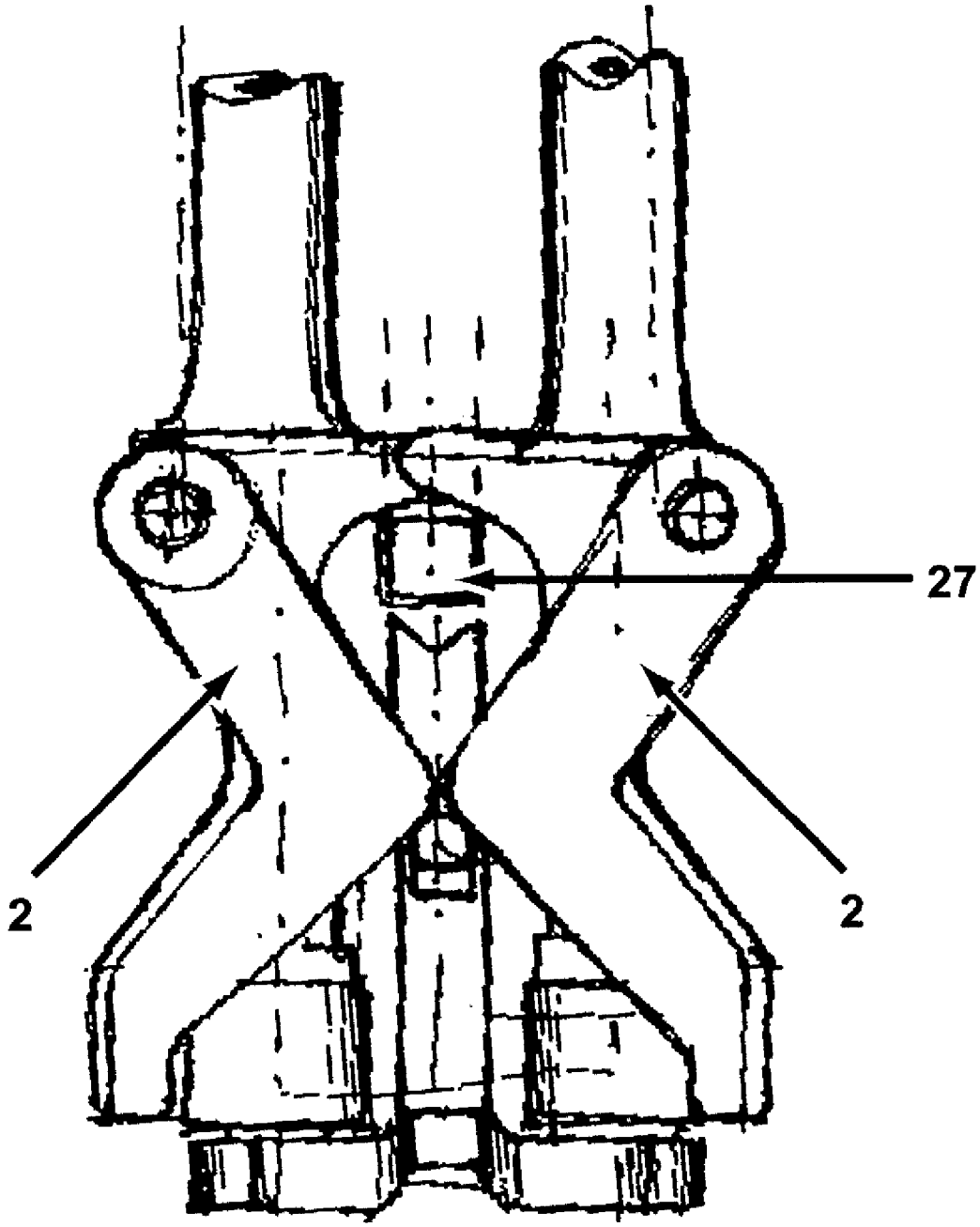
FIG. 22 shows one embodiment of a twin barrel firearm with the recoil device of the present invention with the bolt heads in the forward position.
Figure 23:
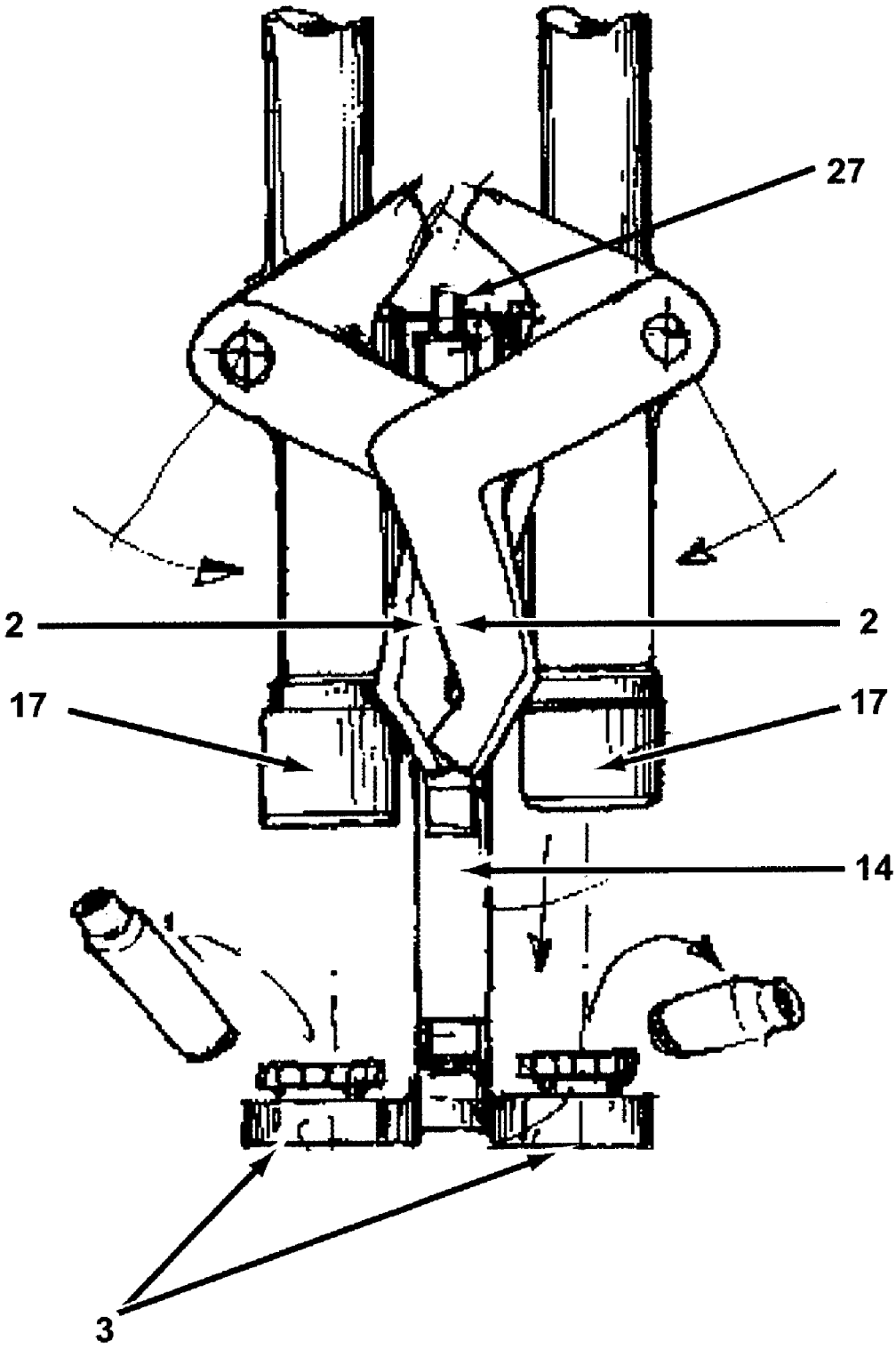
FIG. 23 shows the twin barrel firearm of FIG. 22 with the bolt heads in the rearward position.
Figure 24:
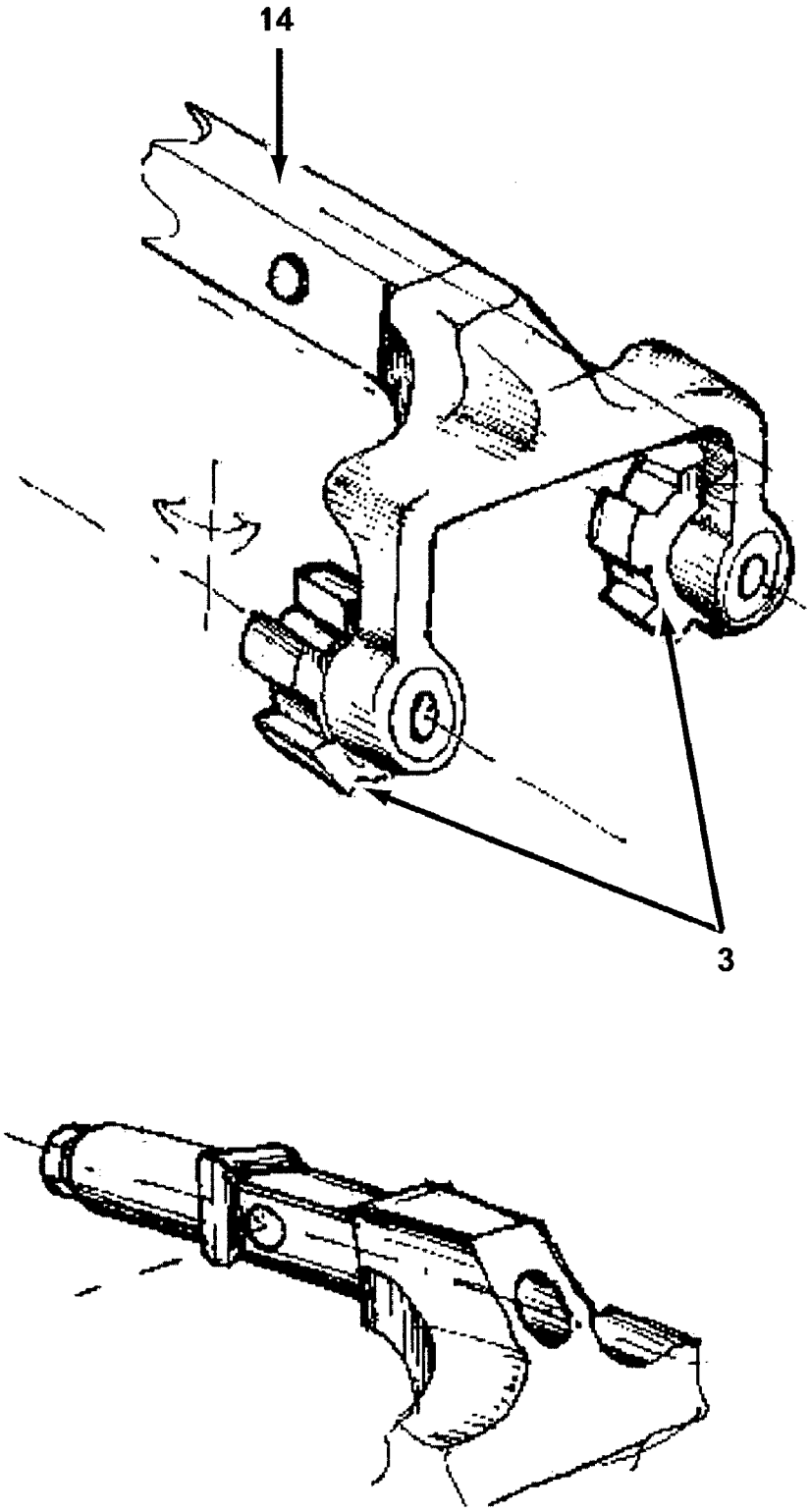
FIG. 24 shows a perspective view of a transporter assembly for use with the twin barrel firearm of FIG. 22.

FIG. 22 shows one embodiment of a twin barrel firearm with a gas injection system, shown with the bolt heads (3) in the forward position. In this embodiment, the recoil control mechanism functions in a similar fashion to the gas injection-equipped single headed firearm of the embodiment of FIG. 9, except that the two bolt heads (3) are preferably connected to a single transporter assembly (14) as shown in FIGS. 23 and 24, permitting the action of the inertia blocks (2) to simultaneously eject both spent cartridges and chamber two new rounds. This has the advantageous effect of permitting a single dud round in either barrel to be automatically ejected and fresh rounds to be chambered in both barrels using the gas pressure generated by the round in the other barrel. Because one barrel generates sufficient gas pressure to cycle the action of both barrels, a single dud in one of the two barrels will not arrest the firing process.

Figure 25:
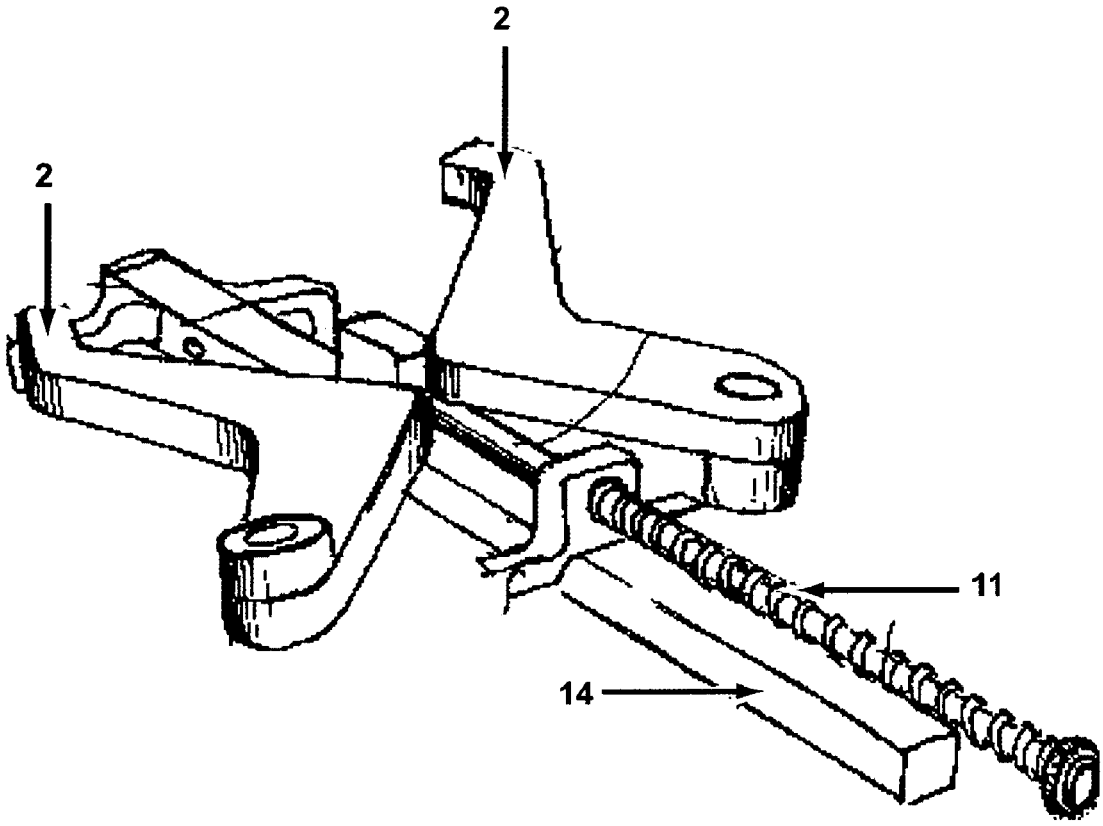
FIG. 25 shows one embodiment for actuating the inertia blocks of the twin barrel firearm of FIG. 22.
Figure 26:
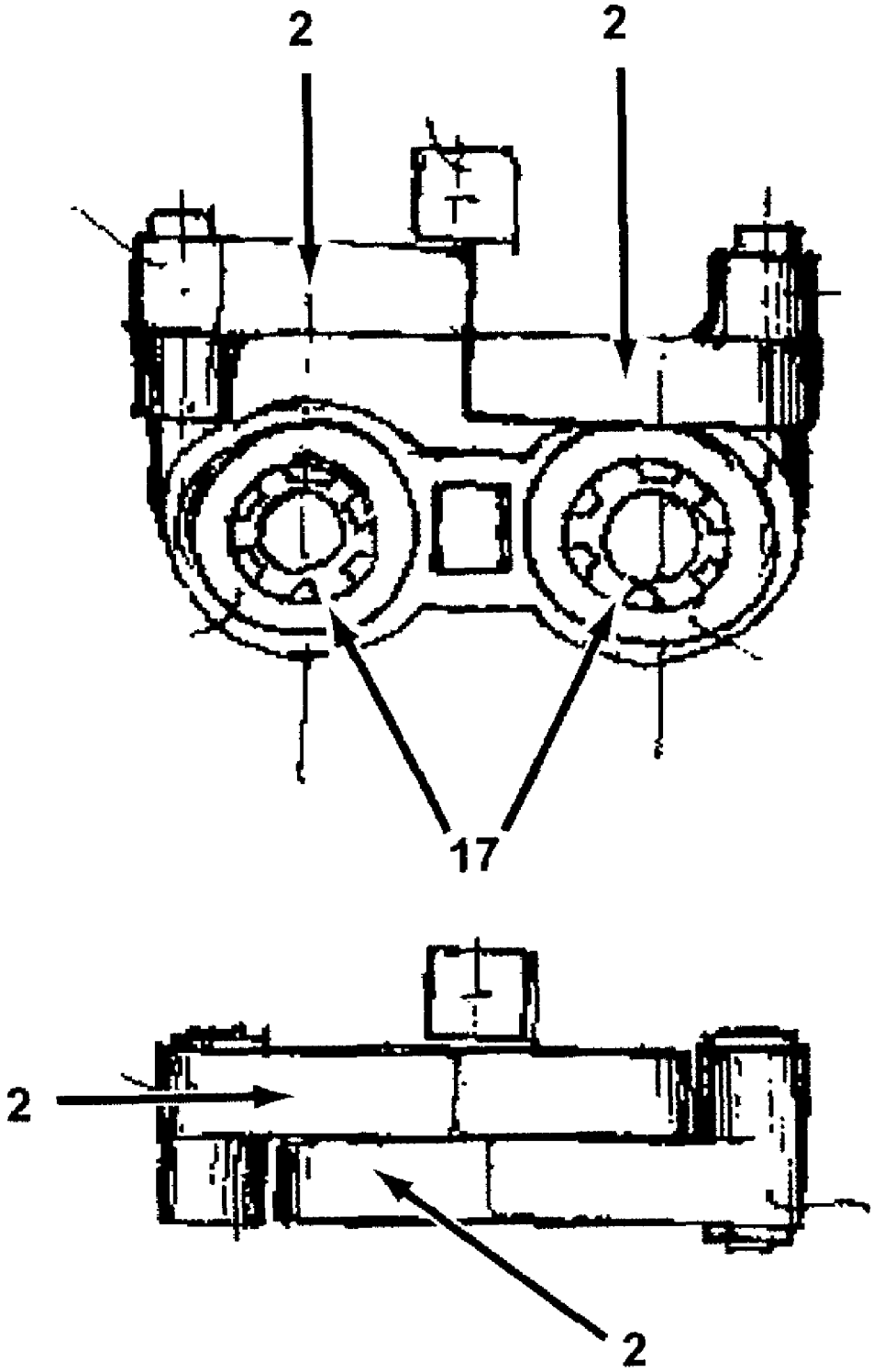
FIG. 26 shows top and side views of the transporter assembly of FIG. 24.
Figure 36:
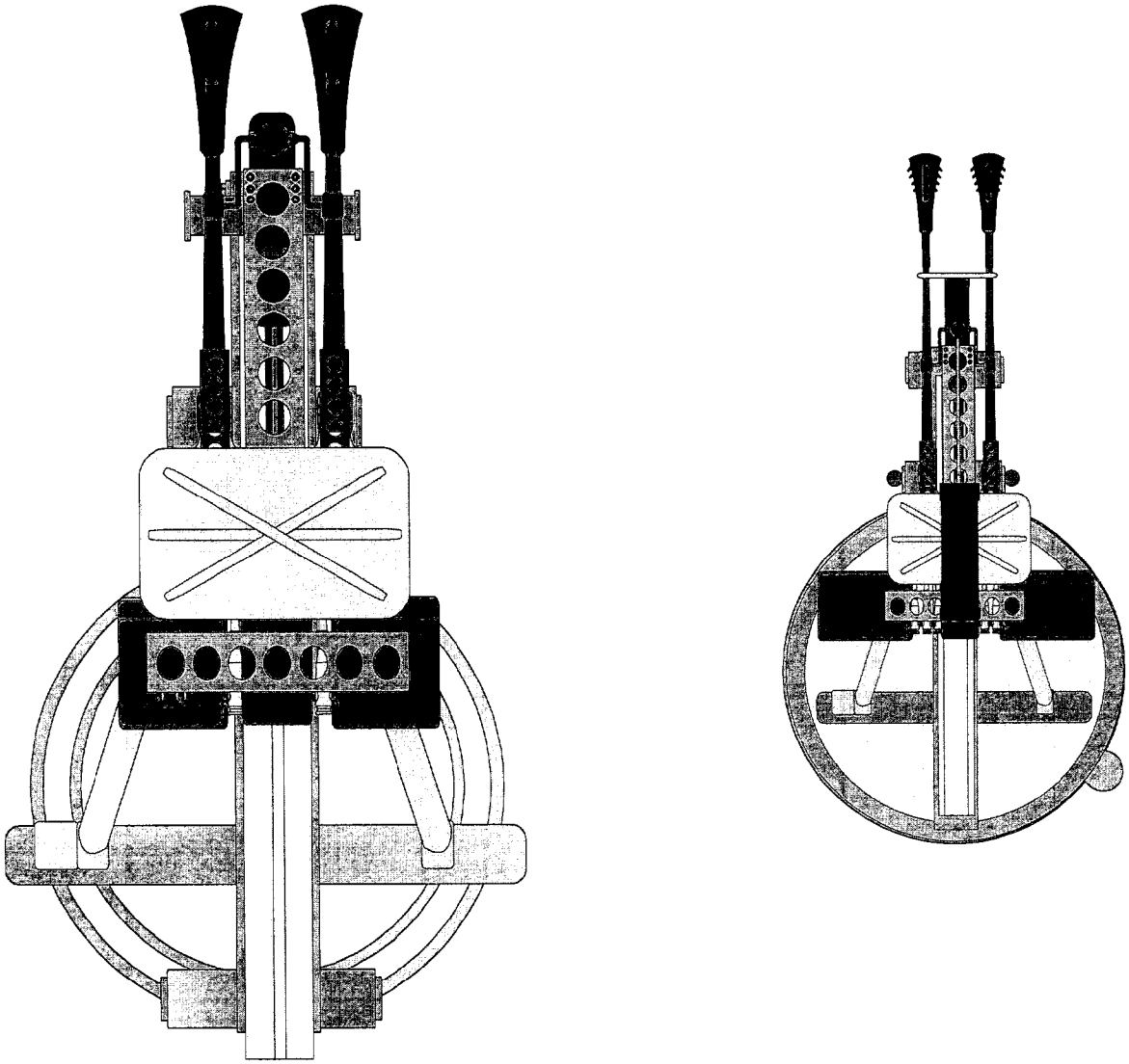
FIG. 36 shows design alternatives for a twin barrel heavy caliber firearm, with inertia blocks positioned above the barrels.

In this embodiment, two inertia blocks may be used to control the recoil of both barrels and may be of the shape as shown in FIGS. 22 and 23 or optionally of the shape shown in FIG. 36. The rotation of the inertia blocks is initially towards each other under the influence of gas pressure from the gas injection system via forcing piston (27), which compresses the return spring (11) as shown in FIG. 25. Because the inertia blocks are of equal mass and move in opposite directions under the influence of substantially similar gas pressure, the forces and moments exerted on the two inertia blocks substantially cancel each other and have no agitating effect on the weapon. As shown in FIG. 26, the inertia blocks (2) may overlap during their rotation and may optionally contact one another or knock together at the conclusion of their displacement.

Figure 27:
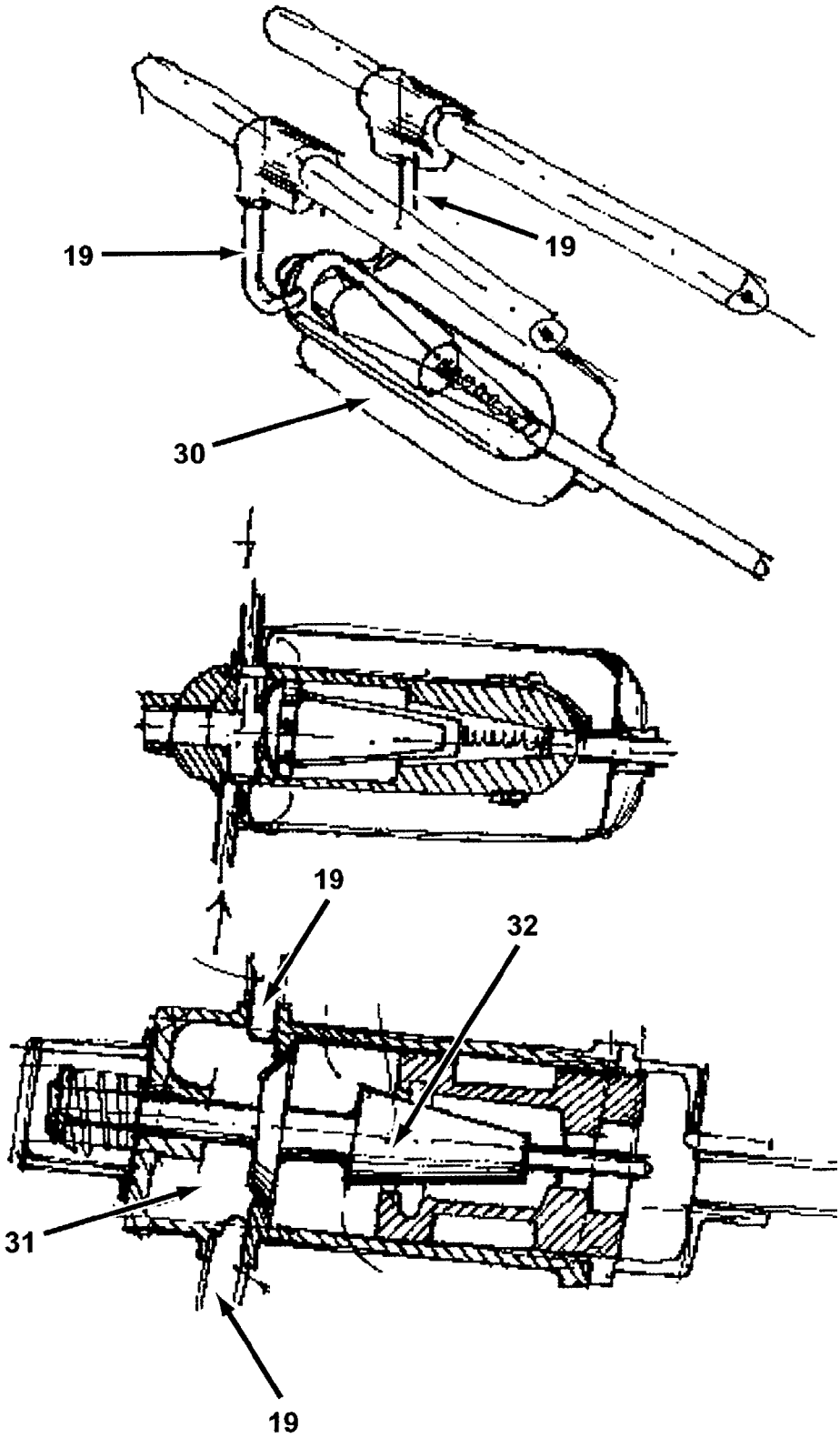
FIG. 27 shows one embodiment of a gas injection system for use with the twin barrel firearm of FIG. 22.
Figure 28:
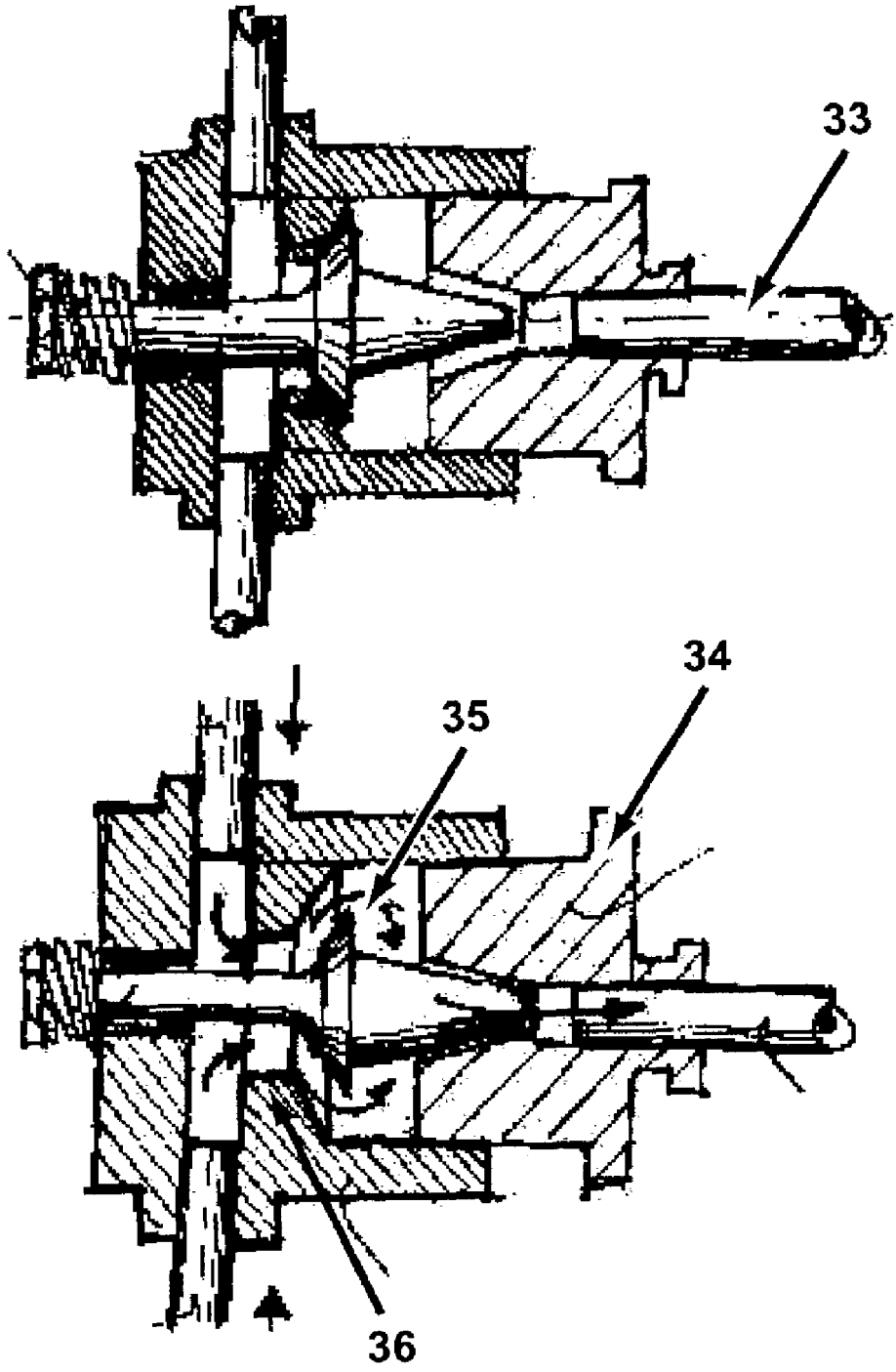
FIG. 28 shows an expanded view of a regulator for use with the gas injection system of FIG. 27.

FIG. 27 shows one embodiment of a gas injection system for use with the twin barrel firearm of FIG. 22. Gas tubes (19) from each of the two barrels will port high-pressure gas from each of the respective barrels to piston regulator (30). Both gas tubes (19) are connected to a common primary chamber (31). This permits pressure from either or both barrels to displace piston (32) and thereby to apply pneumatic pressure to common gas tube (33), as shown in FIG. 28. In this fashion, a dud round in one of the two barrels will not prevent ejection and reloading of fresh rounds in both barrels. The piston regulator (30) can be adjusted by adjustment of adjusting cone (34). The design of piston (32) causes pressure to build up in secondary chamber (35) until pressure in the secondary chamber (35) causes the piston to be pushed against valve seat (36), thereby regulating the pressure in the common gas tube (33) to ensure proper operation of the ejection/reload cycle.

Figure 29:
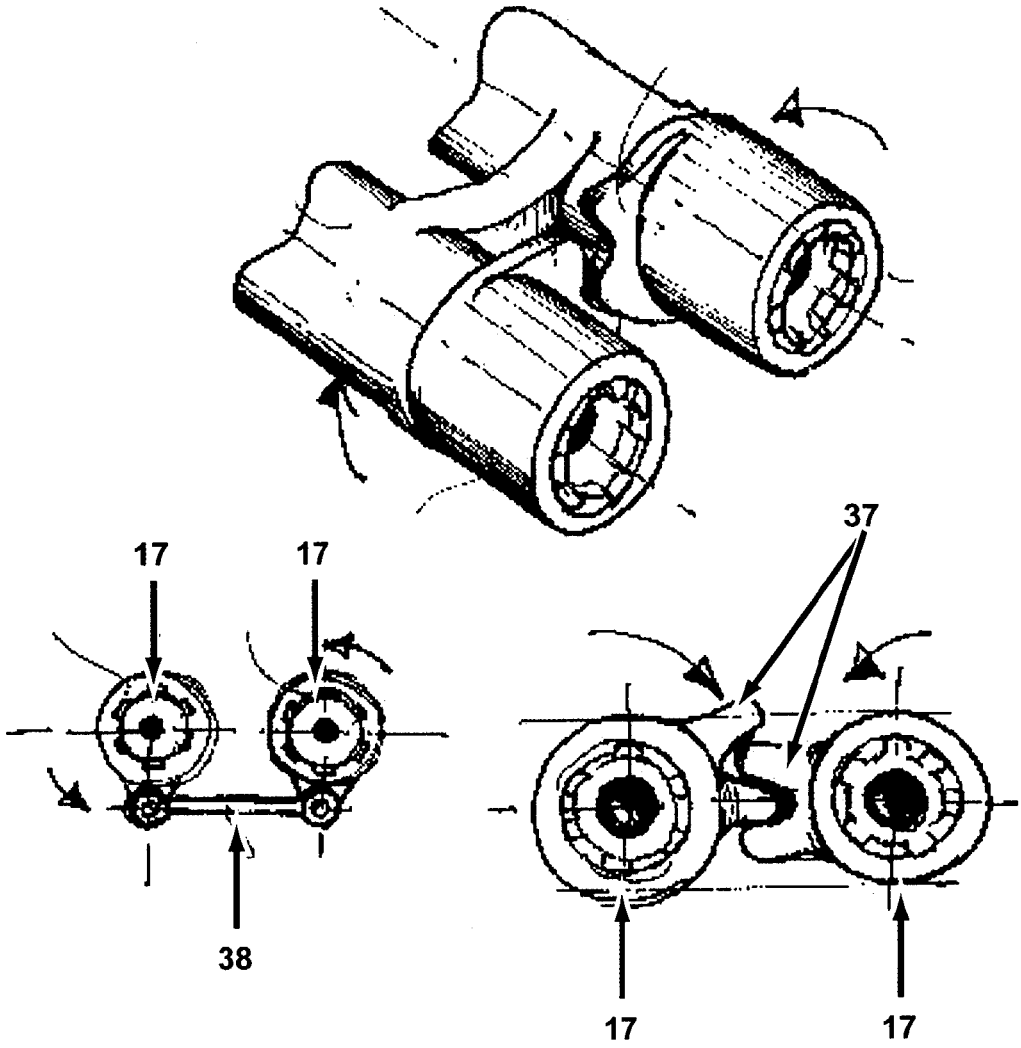
FIG. 29 shows an expanded view of one embodiment of a mechanism for synchronizing the action of the breech locking mechanisms of the twin barrel firearm of FIG. 22.

FIG. 29 shows an expanded view of one embodiment of a mechanism for synchronizing the action of the breech locking mechanisms of the twin barrel firearm of FIG. 22. The breech locking mechanisms for each of the two barrels are mechanically interlocked such that the motion of the inertia blocks causes the two locking spools (17) to lock and unlock substantially in unison. The mechanical interlocks can be accomplished by a variety of mechanical devices. For example, each locking spool (17) can be fitted with a synchronized opener cam (37). The two synchronized opener cams (37) interlock and the two locking spools (17) rotate in opposite directions so that they both lock and unlock substantially in unison. This arrangement is advantageous because it is simple and easy to disassemble. Alternately, the two locking spools (17) may be attached by a drive rod (38), which will also cause the two locking spools to rotate in opposite directions and to lock and unlock substantially in unison.

Figure 30:
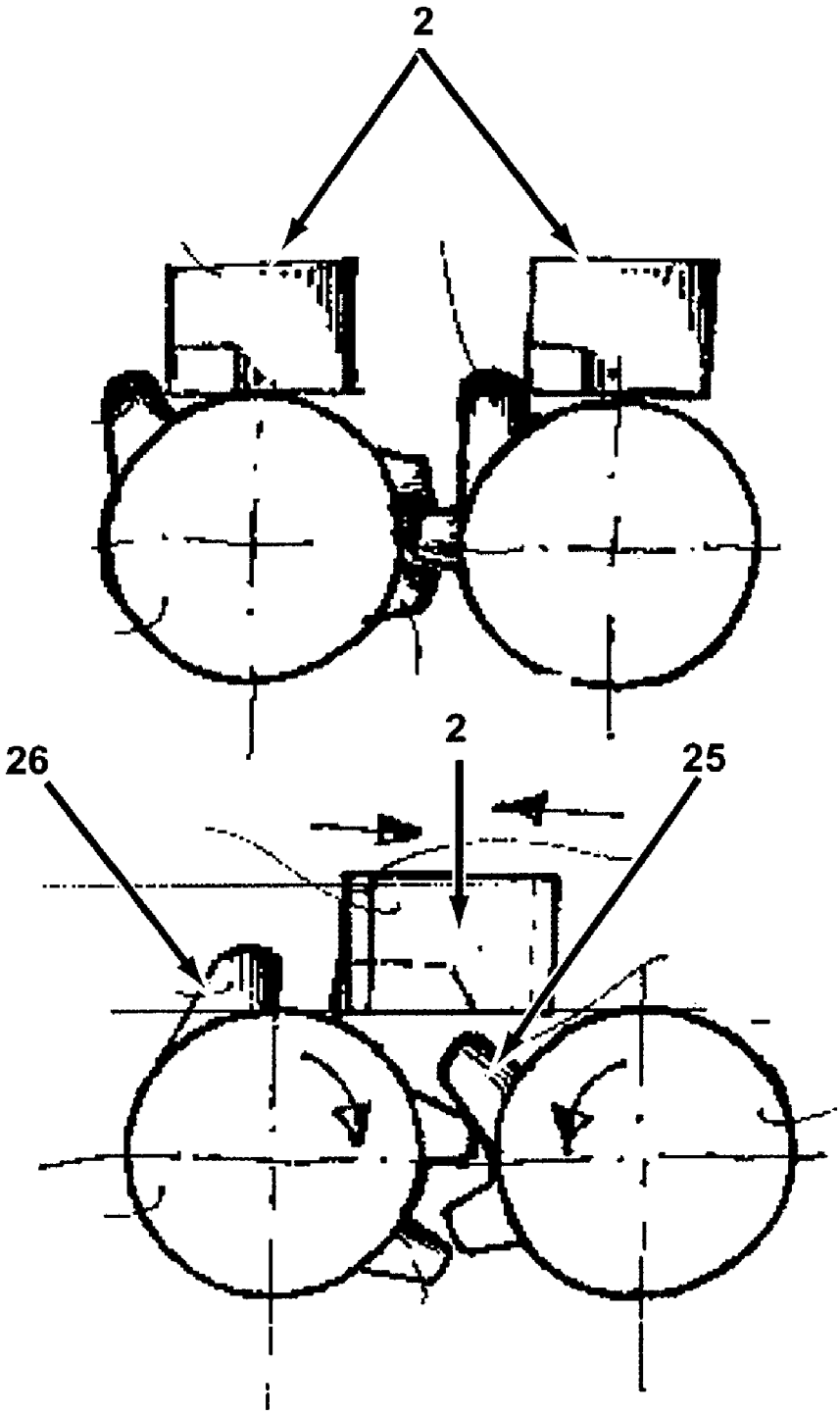
FIG. 30 shows another embodiment of a mechanism for synchronizing the action of the breech locking mechanisms of the twin barrel firearm of FIG. 22.

FIG. 30 shows another embodiment of a mechanism for synchronizing the action of the breech locking mechanisms of the twin barrel firearm of FIG. 22. In this embodiment, the locking and unlocking of the locking spools (17) is driven by the movement of the inertia blocks (2) in similar fashion to the single barrel embodiment of FIG. 18. When the inertia blocks (2) move inward in response to the impulse from forcing piston (27) as described for the embodiment of FIG. 22 above, the right inertia block strikes unlocking cam (25), causing the right locking spool (17) to unlock by rotating counter-clockwise. This rotation causes the synchronized double locking spools (37) to force the left locking spool to rotate clockwise and unlock. Once again the rotation of each of the locking spools (17) preferably is 1/7 of one turn.

In similar fashion, when the recovery mechanism (11) forces inertia blocks (2) outward towards their pre-firing position, the left inertia block in FIG. 30 strikes the locking cam (26) that causes the left locking spool to rotate counterclockwise into the locked position and the right locking spool (17) substantially simultaneously to rotate clockwise into the locked position.

Figure 31:
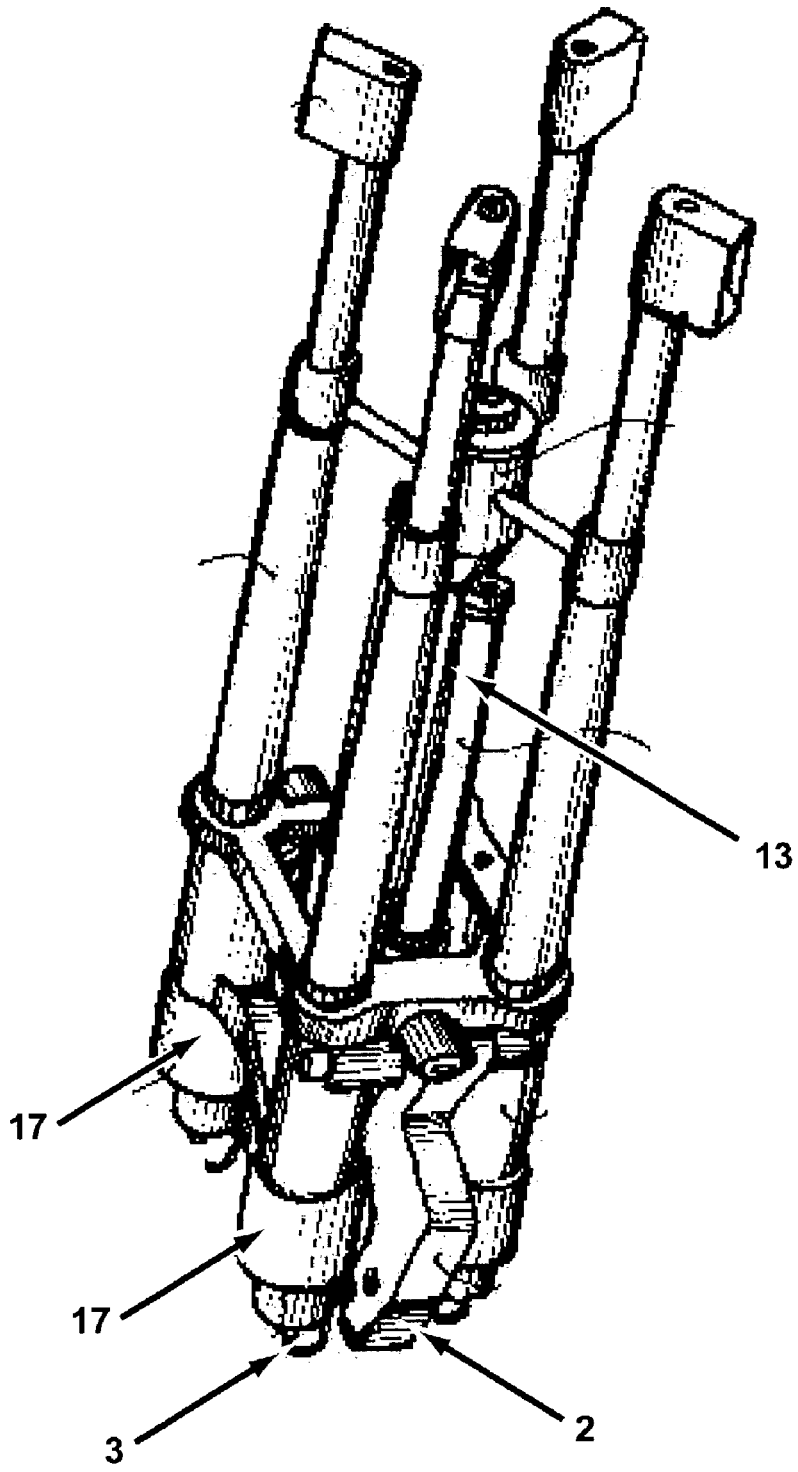
FIG. 31 shows a preferred embodiment of a quad barrel firearm of the present invention.

In yet another preferred embodiment, the foregoing principles can be applied to a quad barrel weapon, as shown in FIG. 31. The quad barrel embodiment is created essentially by combining two twin barrel guns. As with the twin barrel embodiment, the breech locking mechanisms for the four barrels are mechanically interlocked by a series of tenons or other linkages such that the motion of the inertia blocks causes the four mechanisms to lock and unlock substantially in unison. The firing of the four barrels is also synchronized by unified electromagnetic control of the two triggering mechanisms as described for FIG. 7 above. Only two inertia blocks (2) are necessary to manage the recoil forces and moments of the quad barrel system. Similarly, only 10-15% of the gas pressure generated by the nearly simultaneous firing of the four cartridges is necessary to operate the recoil control device, permitting the advantageous ejection of dud rounds in one or more of the four barrels using the gas pressure generated by the firing of at least one good round. As with the twin barrel embodiment, four new cartridges are chambered nearly simultaneously even if one or more of the cartridges in the prior cycle proves defective.

Figure 32:
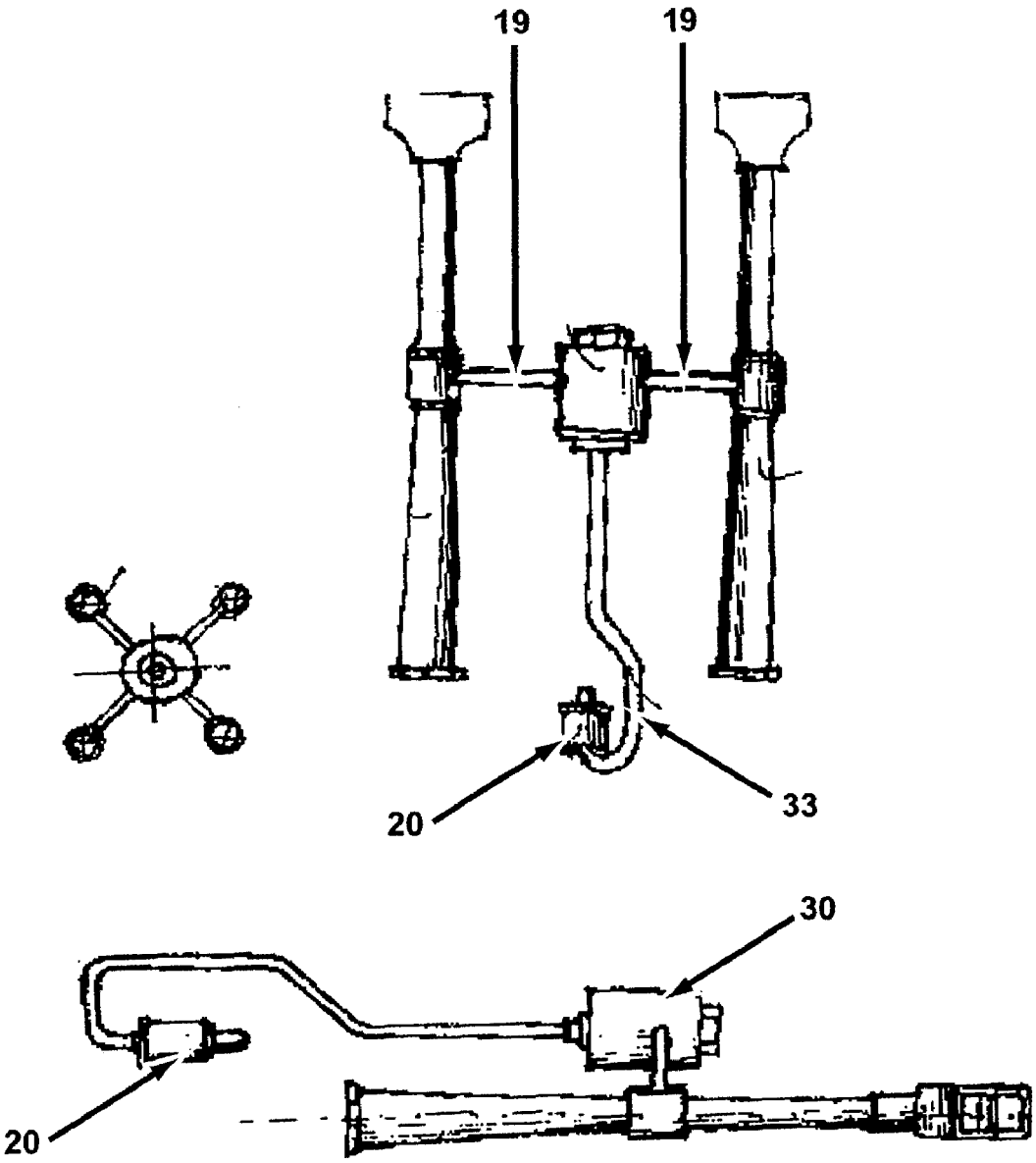
FIG. 32 shows a gas injection system for use with the quad barrel firearm of FIG. 31.

FIG. 32 shows a gas injection system for use with the quad barrel firearm of FIG. 31, wherein a single regulator is used to apply gas pressure from at least one of the four barrels via gas tubes (19) connecting each of the four barrels to a common gas tube (33) via a regulator (30). Regulator (30) can be of a similar design to the embodiment of FIG. 27 or any other suitable design for regulating the pressure supplied to forcing piston (20).

Figure 33:
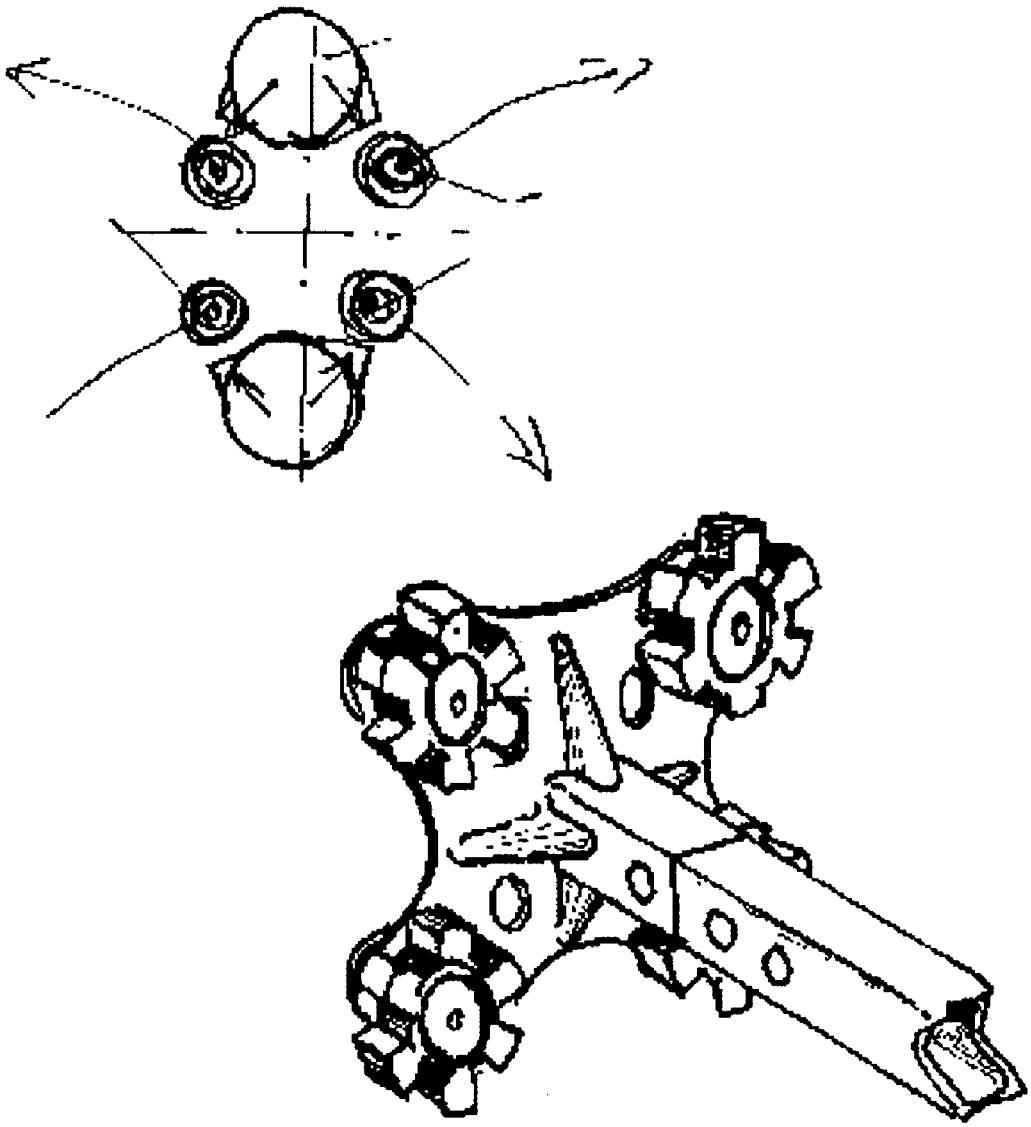
FIG. 33 shows a bolt head assembly for use with the quad barrel firearm of FIG. 31.

FIG. 33 shows a bolt head assembly for use with the quad barrel firearm of FIG. 31. Each of the four bolt heads (3) is connected to a common transporter assembly (14) that permits simultaneous ejection and reloading of all four barrels using the gas pressure from at least one cartridge fired in at least one of the four barrels. This permits dud rounds in one or more of the barrels to be ejected and fresh rounds to be loaded in each of the four barrels as long as at least one round fires in one of the four barrels.

Figure 34:
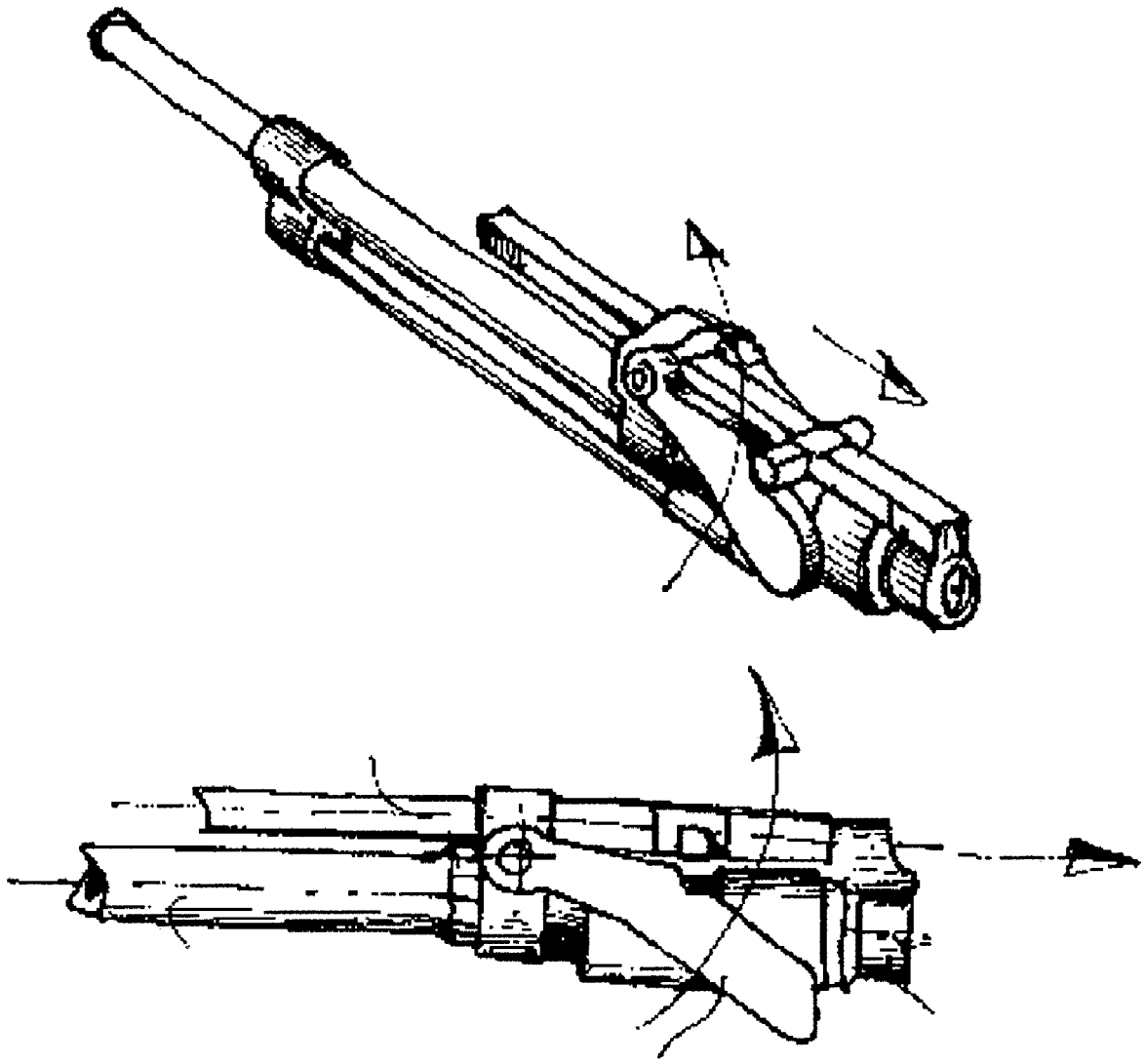
FIG. 34 shows an embodiment where the inertia block rotates upward.

FIG. 34 shows an embodiment where the inertia block rotates upward.

Figure 35:
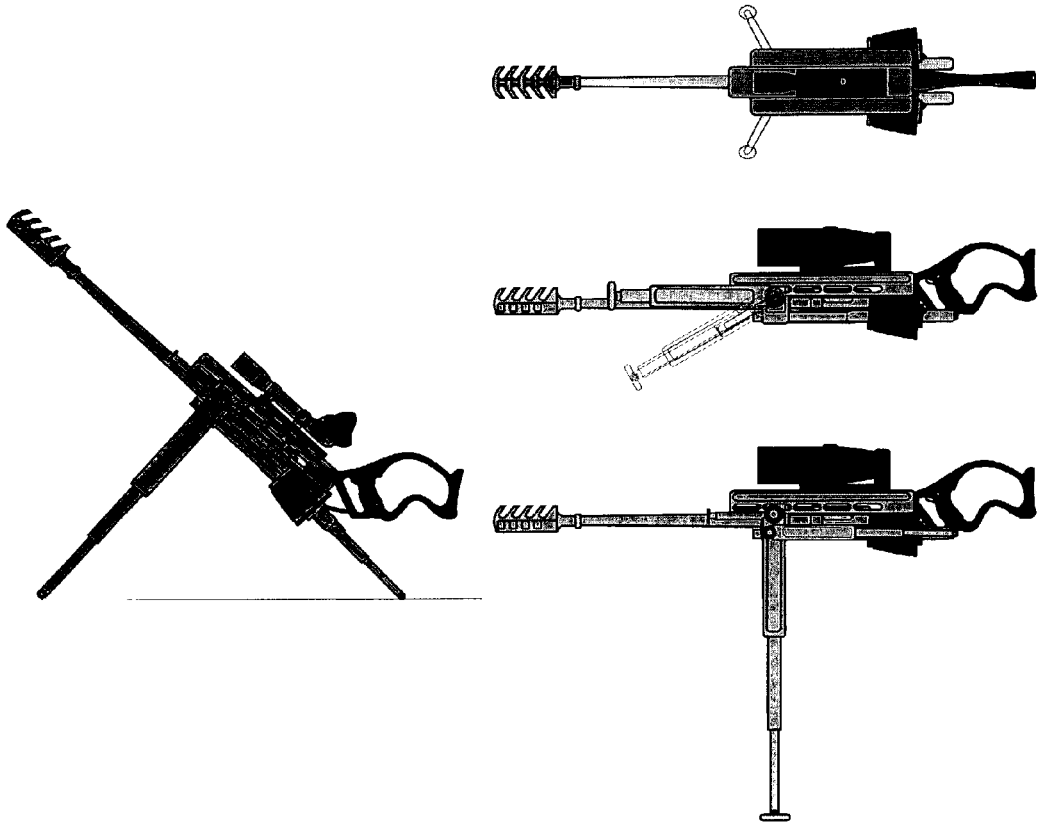
FIG. 35 shows a number of design alternatives in the configuration of a heavy caliber firearm incorporating the invention.

FIG. 35 shows a number of design alternatives in the configuration of a twin barrel heavy caliber firearm, with inertia blocks positioned above the barrels.

FIG. 36 shows an alternative embodiment of a twin barrel firearm of the present invention. In this embodiment, the inertia blocks are preferably of the shape as shown in FIG. 36 and their motion under the influence of the gas pressure from the gas injection system is one of translation with a component perpendicular to the axis of the gun barrel. The direction of translation is constrained by channels, which are preferably oriented at an angle of 45 degrees relative to the axis of the gun barrel, and a spindle. The translation of the inertia blocks is initially towards each other under the influence of gas pressure from the gas injection system, which compresses the return spring. Because the inertia blocks are of equal mass and move in opposite directions under the influence of substantially similar gas pressure, the forces and moments exerted on the two inertia blocks substantially cancel each other and have no agitating effect on the weapon.

Figure 37:
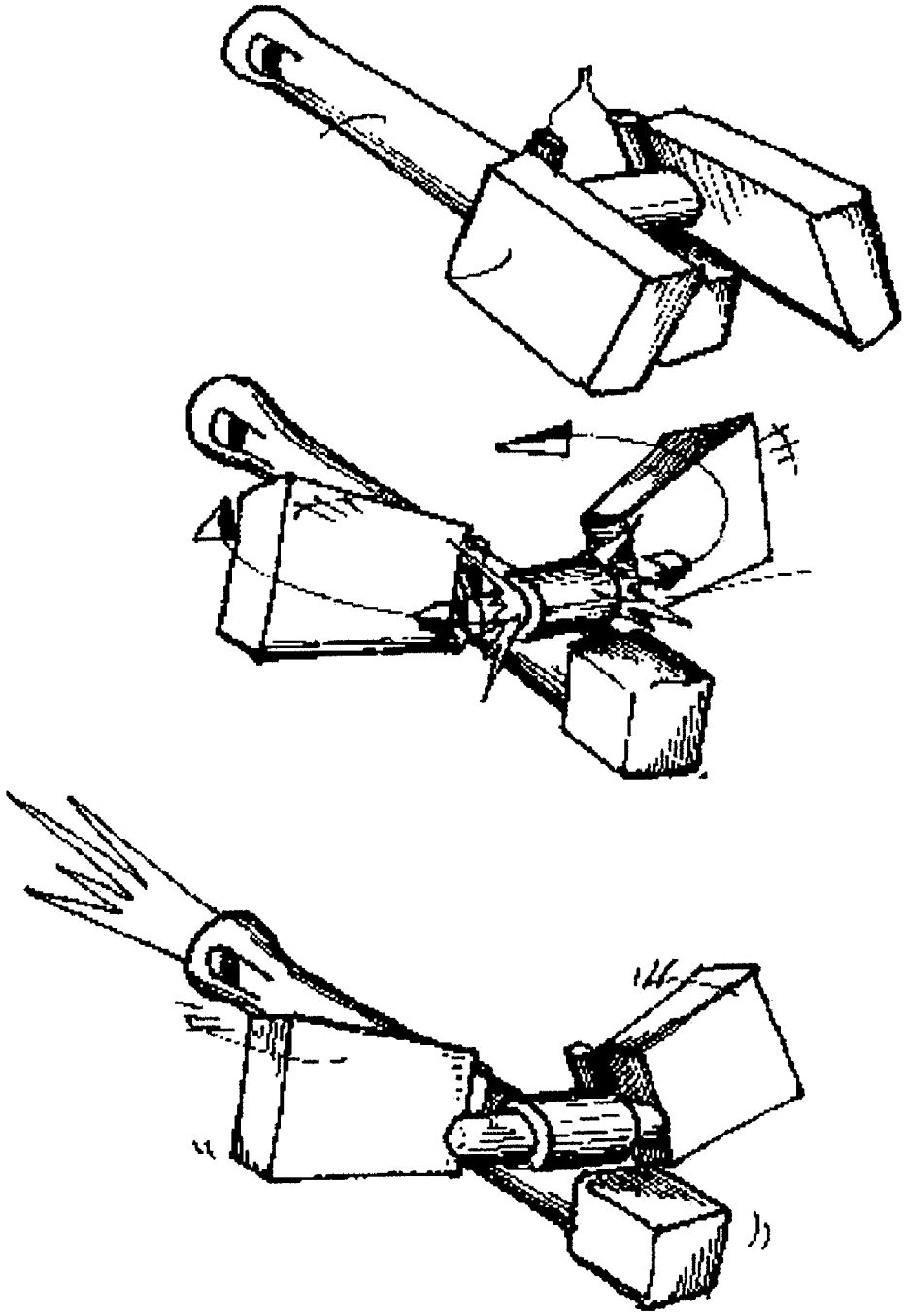
FIG. 37 shows an embodiment where the inertia blocks rotate in response to the firing of a priming charge.

FIG. 37 shows an embodiment where the inertia blocks rotate in response to the firing of a priming charge.

Figure 38:
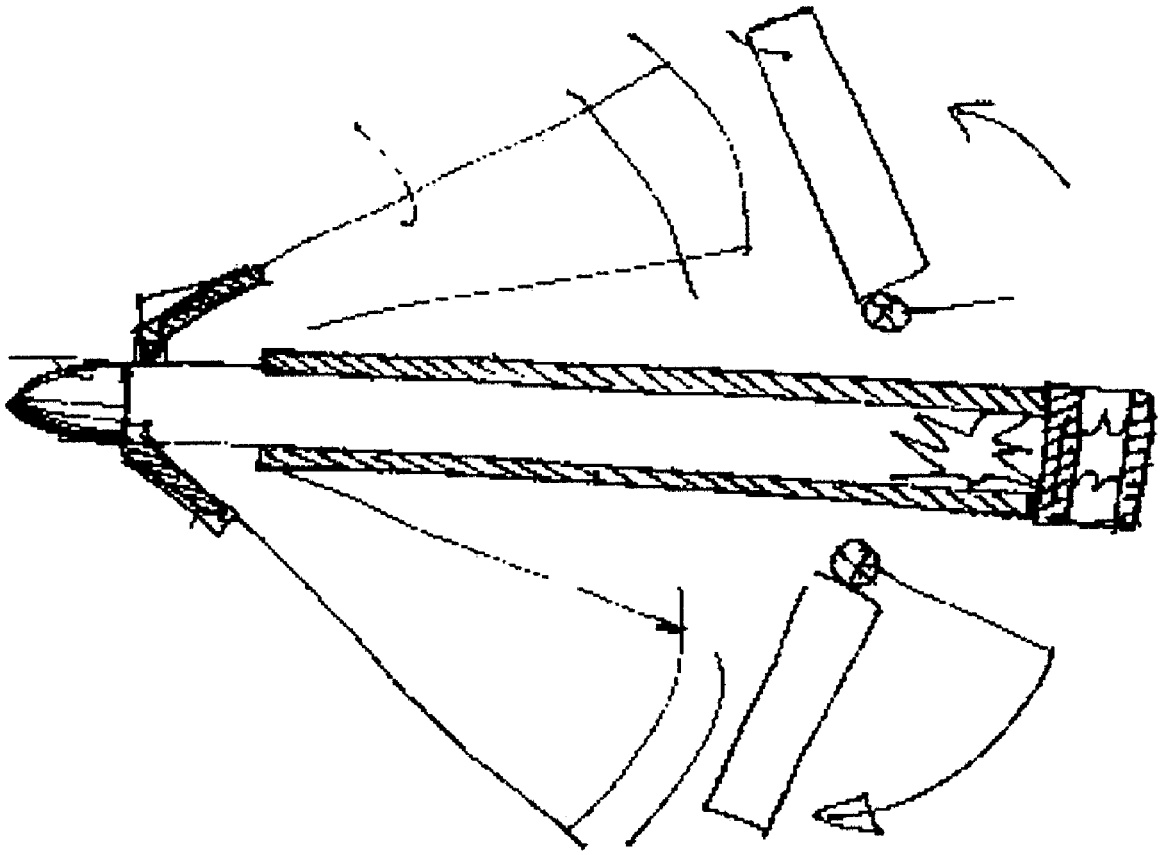
FIG. 38 schematically shows the use of a muzzle brake to deploy the inertia blocks.

FIG. 38 schematically shows the use of a muzzle brake to deploy the inertia blocks.

Figure 39:
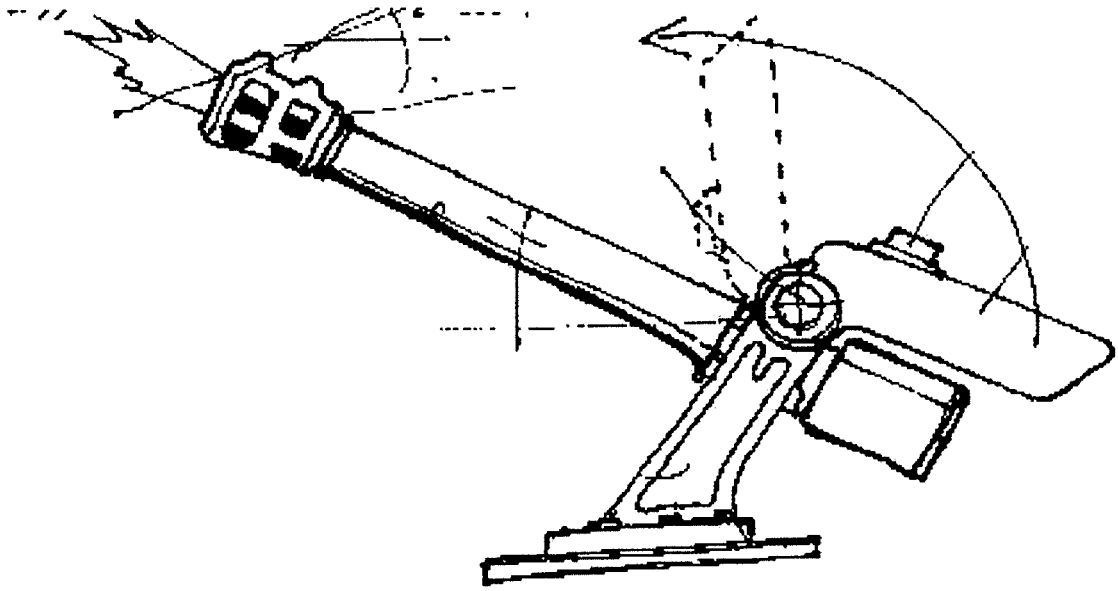
FIG. 39 shows an alternative embodiment and alternative movement of an inertia block.

FIG. 39 shows an alternative embodiment and alternative movement of an inertia block.

Figure 40:
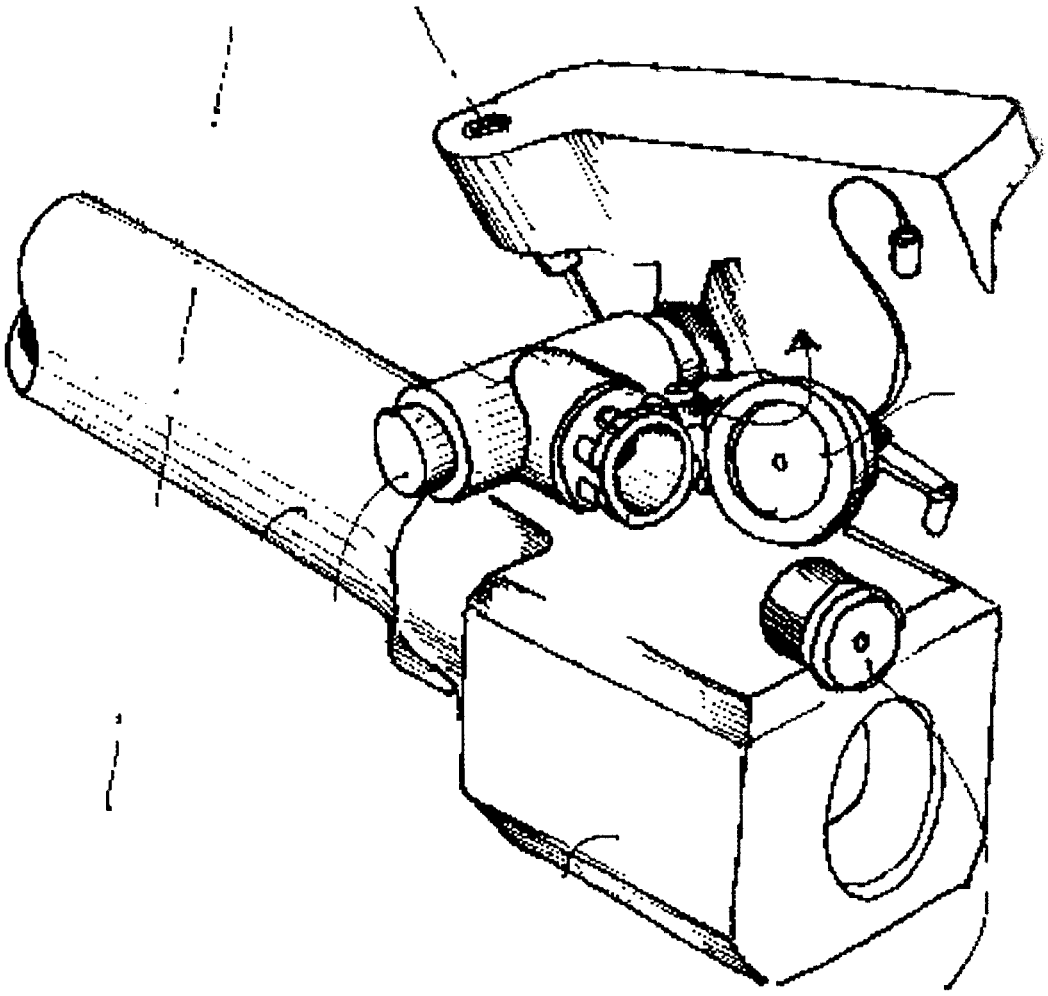
FIG. 40 shows one embodiment of an artillery cannon that uses a primary charge to initiate motion of an inertia block.

FIG. 40 shows one embodiment of an artillery cannon that uses a primary charge to initiate motion of an inertia block.

The following Examples, and forgoing description, are intended to show merely optional configurations for the devices of the invention. Variations, modifications, and additional attachments can be made by one of skill in the art. Thus, the scope of the invention is not limited to any specific Example or any specific embodiment described herein. Furthermore, the claims are not limited to any particular embodiment shown or described here.

Exemplary prototypes incorporating one or more elements of the invention are presented in the following characteristics:

A heavy caliber firearm is produced with an overall length of 1360 mm, and overall width of 120 mm (with extended or open inertia blocks approx. 360 mm), and a barrel length of 878 mm (without muzzle break). The total weight is approximately 25 kg and it is outfitted with a feeding device for 20 round magazines. The expected cycle rate is up to 1500 rpm.

A heavy caliber firearm is produced with an overall length of 1269 mm, and overall width of 160 mm (with extended or open inertia blocks approx. 360 mm), and a barrel length of 878 mm (without muzzle break). The total weight is approximately 25 kg and it is outfitted with a feeding device for 20 round magazines. The expected cycle rate is up to 1500 rpm.

One skilled in the art can devise and create numerous other examples according to this invention. Examples may also incorporate additional firearm elements known in the art, including muzzle brake, multiple barrels, blow sensor, barrel temperature probe, electronic firing control, mechanical firing control, electromagnetic firing control, and targeting system, for example. One skilled in the art is familiar with techniques and devices for incorporating the invention into a variety of firearm examples, with or without additional firearm elements know in the art, and designing firearms that take advantage of the improved force distribution and recoil reduction characteristics of the invention.

What is claimed is:

1. A recoil control system for a weapon, the weapon having at least one barrel with a chamber end and a firing end, a chamber operably connected to the barrel, and a bolt head capable of closing a cartridge in the chamber, the recoil control system comprising:

at least first and second inertia blocks capable of receiving a first and second momentum and the first and second inertia blocks having a component of movement perpendicular to the longitudinal axis defined by the barrel of the weapon;

the bolt head configured to alternate between a forward position and a rearward position in response to the movement of the first and second inertia blocks, the first and second inertia blocks linked to the bolt head whereby the progressive movement of the inertia blocks in response to receiving momentum corresponds with a progressive backward movement of the bolt head substantially along the longitudinal axis defined by the barrel; and a breech locking mechanism separate from the inertia block and configured to be capable of locking the bolt head to the chamber at the chamber end of the barrel.

2. The recoil control system of claim 1, further comprising a gas injection system connected to the at least one inertia block.

3. The recoil control system of claim 1, wherein the bolt head is linked to at least one inertia block having a chamber end and a firing end by a rod.

4. The recoil control system of claim 1, further comprising a transporter assembly for aligning the movement of the bolt head between the forward position and the rearward position substantially with the longitudinal axis of the barrel.

5. The recoil control system of claim 4, wherein the transporter assembly is connected to at least one inertia block.

6. The recoil control system of claim 1, wherein at least one inertia block comprises a first slot.

7. The recoil control system of claim 6, wherein the first slot is oriented at an angle with respect to the longitudinal axis defined by the barrel when a round is chambered.

8. The recoil control system of claim 6, further comprising a transverse spindle for engaging the first slot.

9. The recoil control system of claim 1, further comprising a gas injection system connected to the first and second inertia blocks.

10. The recoil control system of claim 9, wherein the first and second inertia blocks comprise a slot.

11. The recoil control system of claim 10, wherein the slot in the first inertia block is oriented at an angle to the longitudinal axis defined by the barrel and in the second inertia block slot is oriented at an equal and opposite angle with respect to the longitudinal axis defined by the barrel.

12. The recoil control system of claim 10, further comprising a transverse spindle for engaging the first slot and the second slot.

13. The recoil control system of claim 9, wherein the first momentum component imparted on the first inertia block is substantially equal in magnitude and opposite in direction to the second momentum component imparted on the second inertia block in response to firing the weapon.

14. The recoil control system of claim 13, wherein imparting the first momentum component is synchronized with imparting the second momentum component.

15. The recoil control system of claim 9, further comprising a first recovery mechanism for countering the movement of the first inertia block and a second recovery mechanism for countering the movement of the second inertia block.

16. The recoil control system of claim 15, wherein the first recovery mechanism and the second recovery mechanism comprise a spring.

17. The recoil control system of claim 9, further comprising a breech locking mechanism, wherein the locking and unlocking of the breech locking mechanism is controlled by the movement of the second inertia block.

18. The recoil control system of claim 1, further comprising a first recovery mechanism for countering the movement of the first inertia block.

19. The recoil control system of claim 18, wherein the first recovery mechanism comprises a spring.

20. The recoil control system of claim 1, wherein the breech locking mechanism rotates.

21. The recoil control system of claim 20, wherein the breech locking mechanism restricts rearward movement of the bolt head when in a locked position and permits rearward movement of the bolt head when in an unlocked position.

22. The recoil control system of claim 21, wherein the breech locking mechanism is rotated one-seventh of one revolution about the longitudinal axis defined by the barrel to move between the locked and the unlocked position.

23. The recoil control system of claim 21, wherein the bolt head comprises a first plurality of tenons and the breech locking mechanism comprises a second plurality of tenons.

24. The recoil control system of claim 23, wherein the second plurality of tenons are aligned with the first plurality of tenons to restrict rearward movement of the bolt head when the breech locking mechanism is in the locked position.

25. The recoil control system of claim 23, wherein the second plurality of tenons are not aligned with the first plurality of tenons, thereby permitting rearward movement of the bolt head when the breech locking mechanism is in the unlocked position.

26. The recoil control system of claim 20, wherein the breech locking mechanism is rotated about the longitudinal axis defined by the barrel to move between the locked and the unlocked position.

27. The recoil control system of claim 26, wherein the rotation of the breech locking mechanism is controlled by the movement of an inertia block.

28. The recoil control system of claim 20, wherein the locking and unlocking of the breech locking mechanism is controlled by the movement of an inertia block.

29. The recoil control system of claim 1, wherein the breech locking mechanism comprises a plurality of tenons.

30. A method of controlling recoil in a weapon comprising:

firing a projectile that generates high-pressure gases; and applying a portion of the high-pressure gases to first and second inertia blocks to impart a momentum component perpendicular to the longitudinal axis defined by the barrel to the inertia blocks, the first and second inertia blocks linked to a bolt head of the weapon whereby the progressive movement of the inertia blocks corresponds with the progressive backward movement of the bolt head substantially along the longitudinal axis of the barrel.

31. The method of claim 30, wherein the movement of the first and second inertia blocks in response to the high-pressure gases is constrained by a first oblique slot in the first and second inertia block that slides along a fixed spindle.

32. The method of claim 30, wherein the momentum component of the first inertia block is substantially equal in magnitude and opposite in direction to the momentum component of the second inertia block.

33. The method of claim 30, wherein imparting the momentum component to the first and second inertia blocks is synchronized.

34. The method of claim 30, wherein the movement of the second inertia block in response to the high-pressure gases is constrained by a second oblique slot in the inertia block that slides along a fixed spindle.

35. The method of claim 30, wherein the high-pressure gases are applied to the first inertia block by a gas injection system.

36. The method of claim 30, wherein the weapon comprises a breech locking mechanism separate from the first inertia block, and further comprising:

locking the breech of the weapon to prevent the movement of a bolt head under the influence of the high-pressure gases; and unlocking the breech of the weapon to allow the backward movement of the bolt head to eject a spent cartridge and to feed a new cartridge.

37. The method of claim 36, wherein the locking and unlocking of the breech of the weapon is controlled by the movement of the first inertia block.

38. The method of claim 36, wherein the locking and unlocking of the breech of the weapon is controlled by the movement of a second inertia block.

* * * * *